US010961748B2

(12) United States Patent
Albrecht

(10) Patent No.: US 10,961,748 B2
(45) Date of Patent: Mar. 30, 2021

(54) WINDOW TILT LATCH SYSTEM

(71) Applicant: Sierra Pacific Industries, Anderson, CA (US)

(72) Inventor: Scott D. Albrecht, Merrill, WI (US)

(73) Assignee: Sierra Pacific Industries, Anderson, CA (US)

( * ) Notice: Subject to any disclaimer, the term of this patent is extended or adjusted under 35 U.S.C. 154(b) by 202 days.

(21) Appl. No.: 16/024,079

(22) Filed: Jun. 29, 2018

(65) Prior Publication Data

US 2019/0003208 A1 Jan. 3, 2019

Related U.S. Application Data

(60) Provisional application No. 62/527,824, filed on Jun. 30, 2017.

(51) Int. Cl.

| | |
|---|---|
| ***E05B 65/08*** | (2006.01) |
| ***E05C 9/18*** | (2006.01) |
| ***E05D 15/22*** | (2006.01) |
| ***E05C 1/10*** | (2006.01) |
| ***E05C 9/20*** | (2006.01) |
| ***E05C 7/00*** | (2006.01) |

(52) U.S. Cl.

CPC ..... *E05B 65/0876* (2013.01); *E05B 65/0811* (2013.01); *E05C 1/10* (2013.01); *E05C 7/00* (2013.01); *E05C 9/1833* (2013.01); *E05C 9/1875* (2013.01); *E05C 9/20* (2013.01); *E05D 15/22* (2013.01); *E05C 2007/007* (2013.01); *E05Y 2900/148* (2013.01)

(58) Field of Classification Search

CPC ..... E05C 2007/007; E05C 3/046; E05C 9/00; E05C 1/10; E05D 15/22; E05Y 2900/148; E05B 53/003; E05B 65/0876; Y10S 292/20; Y10S 292/47; E06B 3/5063

See application file for complete search history.

(56) References Cited

U.S. PATENT DOCUMENTS

| | | | | |
|---|---|---|---|---|
| 3,522,675 A * | 8/1970 | Metzger | E06B 3/44 | 49/451 |
| 6,141,913 A * | 11/2000 | Wong | E05D 15/22 | 49/183 |
| 6,588,150 B1 * | 7/2003 | Wong | E05B 53/003 | 49/183 |
| 6,672,009 B1 * | 1/2004 | Wong | E05D 15/22 | 49/181 |

(Continued)

*Primary Examiner* — Justin B Rephann

(74) *Attorney, Agent, or Firm* — Merchant & Gould P.C.

(57) ABSTRACT

A window assembly is disclosed including a window casing; a sash assembly slidably mounted within the window casing, the sash assembly including first and second stiles extending between first and second rails; a first tilt latch assembly mounted in the first stile; a second tilt latch assembly mounted in the second stile; and a sash lock mounted to the first rail, the sash lock being operably connected to the first and second tilt latch assemblies to operate the first and second tilt latch assemblies between a latched position in which a latch member of each of the first and second tilt latch assemblies engages with the window casing assembly and an unlatched position in which the latch member of each of the first and second tilt latch assemblies is disengaged with the window casing assembly.

14 Claims, 24 Drawing Sheets

(56) References Cited

U.S. PATENT DOCUMENTS

| | | | | |
|---|---|---|---|---|
| 6,679,001 | B1 * | 1/2004 | Guelck | E05D 15/22 49/183 |
| 6,817,142 | B2 * | 11/2004 | Marshik | E05B 65/0835 292/DIG. 20 |
| 6,877,784 | B2 * | 4/2005 | Kelley | E05B 53/003 292/141 |
| 6,938,373 | B2 * | 9/2005 | Wong | E05D 15/22 49/181 |
| 6,957,513 | B2 * | 10/2005 | Pettit | E05B 5/003 292/141 |
| 7,070,215 | B2 | 7/2006 | Kelley et al. | |
| 7,412,800 | B2 | 8/2008 | Maier | |
| 7,963,577 | B2 * | 6/2011 | Wolf | E05C 3/046 292/241 |
| 8,550,507 | B2 * | 10/2013 | Barton | E06B 3/5063 292/194 |
| 8,955,255 | B2 * | 2/2015 | DeBoer | E06B 7/02 49/185 |
| 9,562,378 | B2 | 2/2017 | DeBoer et al. | |
| 10,119,310 | B2 * | 11/2018 | Liang | E05B 63/0056 |
| 2009/0265997 | A1 * | 10/2009 | Flory | E05B 53/00 49/394 |
| 2010/0132263 | A1 * | 6/2010 | Flory | E05D 15/22 49/395 |
| 2011/0192089 | A1 * | 8/2011 | Barton | E05C 3/10 49/394 |
| 2013/0283694 | A1 * | 10/2013 | DeBoer | E05C 3/12 49/186 |
| 2017/0152688 | A1 * | 6/2017 | Liang | E05C 9/025 |

* cited by examiner

100

WINDOW TILT LATCH SYSTEM

RELATED APPLICATIONS

This application claims priority to U.S. Provisional Patent Application Ser. No. 62/527,824, filed on Jun. 30, 2017, the entirety of which is incorporated by reference herein.

TECHNICAL FIELD

This disclosure relates generally to window assemblies, and methods of constructing window assemblies.

BACKGROUND

Many window assemblies are provided with tilt latches and tilt pins that enable one or more sashes to be rotated with respect to a window casing. Such features enable the sash to be accessed and/or removed from one side of the window assembly. In many configurations, the tilt latches and tilt pins also act as the guide members for the sash to slide within the window casing assembly, and thus provide the only means of support for the sash with respect to the window frame. In double hung window applications, especially tall or high aspect ratio window applications, the stiles of the sash can bow under wind load. This load adds stress to the tilt latch at the top of the sash and the tilt pin at the bottom of the sash. Typically, there is no support in the middle of the stile.

Referring to FIG. 2, a typical known tilt latch mechanism 10 is shown in which a sash lock 12 operates a pair of tilt latches 14 that are mounted to the top of a window sash 16. With this type of construction, the check or meeting rail profile is forced to get taller in order to fit the sash lock hardware. Most hardware requires the tilt latch 14 to be located at the end of the check rail 16 in order for the sash lock 12 to work with the tilt latch 14. The majority of sash locks 12 are also mortised into the top of the check rail 16. The off-end tilt latch 14 and mortised sash lock 12 combine to make the checkrail profile taller, contradictory to the design element of a slim check rail that is desired with many window genres.

SUMMARY

A window assembly is disclosed including a window casing; a sash assembly slidably mounted within the window casing, the sash assembly including first and second stiles extending between first and second rails; a first tilt latch assembly mounted in the first stile; a second tilt latch assembly mounted in the second stile; and a sash lock mounted to the first rail, the sash lock being operably connected to the first and second tilt latch assemblies to operate the first and second tilt latch assemblies between a latched position in which a latch member of each of the first and second tilt latch assemblies engages with the window casing assembly and an unlatched position in which the latch member of each of the first and second tilt latch assemblies is disengaged with the window casing assembly.

In one example window assembly, a window casing assembly, a first sash assembly, and a tilt latch assembly, and a sash lock are provided. In one aspect, the first sash assembly is slidably mounted within the window casing assembly. In one aspect, the tilt latch assembly is mounted to a stile of the first sash assembly and includes a latch member. In one aspect, the sash lock is mounted to a rail of the sash assembly, wherein the sash lock operates the tilt latch assembly between a latched position in which the latch member operably engages with the window casing and an unlatched position in which the latch member is disengaged from the window casing assembly.

In some examples, two first tilt latch assemblies are provided in the first stile and two second tilt latch assemblies are provided in the second stile.

In some examples, the window assembly is a double hung window including a second sash assembly.

In some examples, the sash lock secures the first sash assembly to the second sash assembly when the sash lock is in a locked position.

In some examples, the first and second tilt latch assemblies are connected to the sash lock by a balance cord.

In some examples, each of the first and second tilt latch assemblies are spring biased into the latched position.

In some examples, each of the first and second tilt latch assemblies includes a main housing, a slide member slidably retained within the main housing, and a latch member rotatably connected to the slide member.

In some examples, the latch member is in direct contact with the main housing when in the latched position.

In one aspect of the disclosure a tilt latch assembly is disclosed including a main housing defining an open channel, a slide member slidably disposed within the open channel; and a latch member rotatably mounted to the slide member, the latch member being rotatable from an unlatched position in which a majority of the latch member resides within the open channel and a latched position in which a majority of the latch member extends out of the open channel and beyond a face of the main housing. In some examples, the slide member defines a second open channel within which the spring is disposed. In some examples, the main housing includes a tab structure extending into the second open channel, wherein one end of the spring abuts the tab structure. In some examples, the face of the main housing defines an aperture through which the latch member extends when in the latched position. In some examples, the latch member is connected to the slide member by a pin. In some examples, the latch member includes a pair of sidewalls straddling a tab structure of the main housing, when the latch member is in the latched position.

DETAILED DESCRIPTION OF THE DRAWINGS

Reference will now be made in detail to exemplary aspects of the present disclosure that are illustrated in the accompanying drawings. Wherever possible, the same reference numbers will be used throughout the drawings to refer to the same or like parts.

Figure 1:
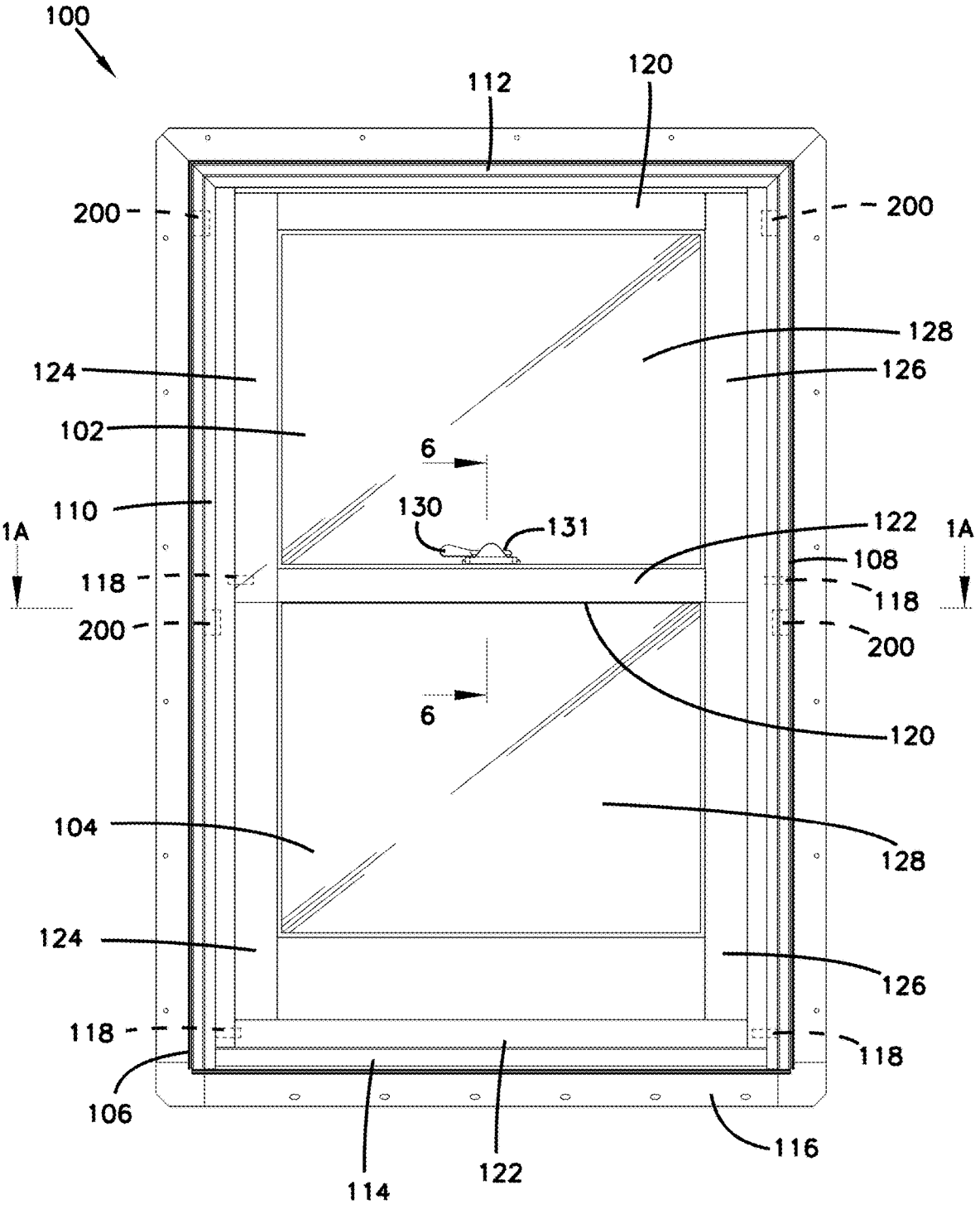
FIG. 1 is a front view of a double hung style window assembly having features in accordance with the present disclosure.

Referring to FIG. 1, a window assembly 100. The window assembly 100 is configured as a double hung window. However, other window types may be used with the concepts presented herein. As presented, the window assembly 100 includes a first or top sash 102 and a second or bottom sash 104, both of which are slidably secured within a window casing 106. In one aspect, each of the top and bottom sashes 102, 104 is provided with a top rail 120, a bottom rail 122, and a pair of stiles 124, 126 extending between the top and bottom rails 120, 122. The rails 120, 122 and stiles 124, 126 secure glazing 128 within the sashes 102, 104.

In one aspect, the window casing 106 is defined by a pair of side jambs 108, 110 extending vertically between a head 112 and a sill 114. In some applications, the window casing 106 can be provided with a nail fin 116 to enable the window casing 106 to be secured to a building structure once the casing has been installed within an opening of the building structure. Although only shown in limited detail at FIG. 1, each of the top and bottom sashes 102, 104 is provided with a pair of tilt latches 200 at the top of the sash 102 and a pair of tilt pins or pivot bars 118 at the bottom of the sash. Tilt pins and pivot bars 118 are well known to those skilled in the art and need not be further discussed herein. In one aspect, the position of the sashes 102, 104 can be locked by a sash lock 130 on the bottom sash 104 that engages with a keeper 131 on the top sash 102 to secure the bottom rail 122 of the top sash 102 to the top rail 120 of the bottom sash 104.

As noted previously, taller windows are subject to the stiles bowing under wind load. There are several genres in the industry. The example shown at FIG. 1 is termed "contemporary", in which architects and builders want less visible framing around the glass to maximize the viewing area. Contemporary style windows use very little character in the sash and frame components. Many parts are square with sharp corners. Another timeless genre is historical or traditional. This genre captures the design intent of yesteryear. This incorporates a tall bottom rail, slim check rails, ogee profiled sash, and other design features to highlight the perimeter framing. The tilt latch assembly concepts disclosed herein are equally applicable to each of these style types.

Figure 3:
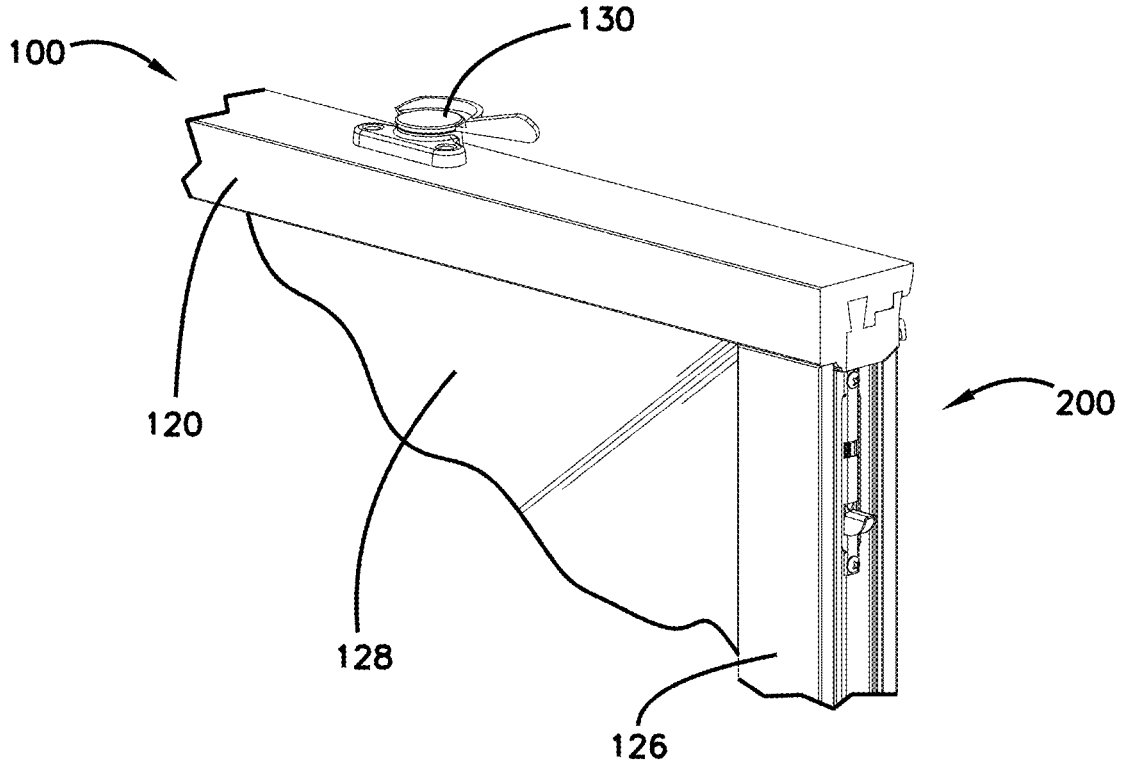
FIG. 3 is an interior perspective view of a portion of the sash portion of the window assembly shown in FIG. 1.
Figure 4:
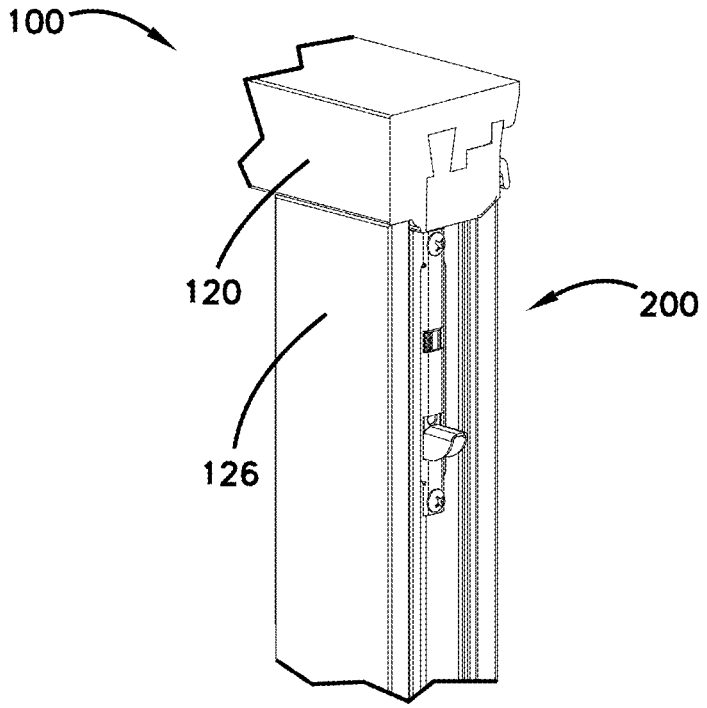
FIG. 4 is an enlarged view of a portion of the sash shown in FIG. 3.
Figure 5:
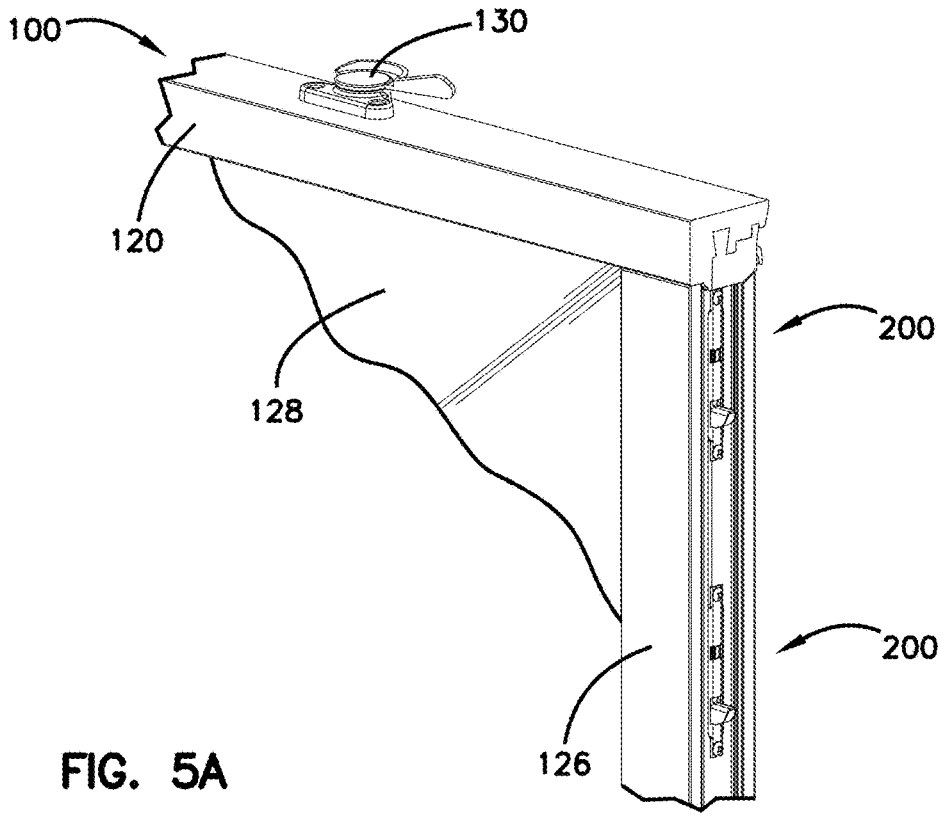
FIG. 5 is an interior perspective view of an alternative sash usable with the window assembly shown in FIG. 1, the sash including a pair of tilt latch assemblies on each side of the sash, the tilt latch assemblies being shown in the latched position.
Figure 5A:
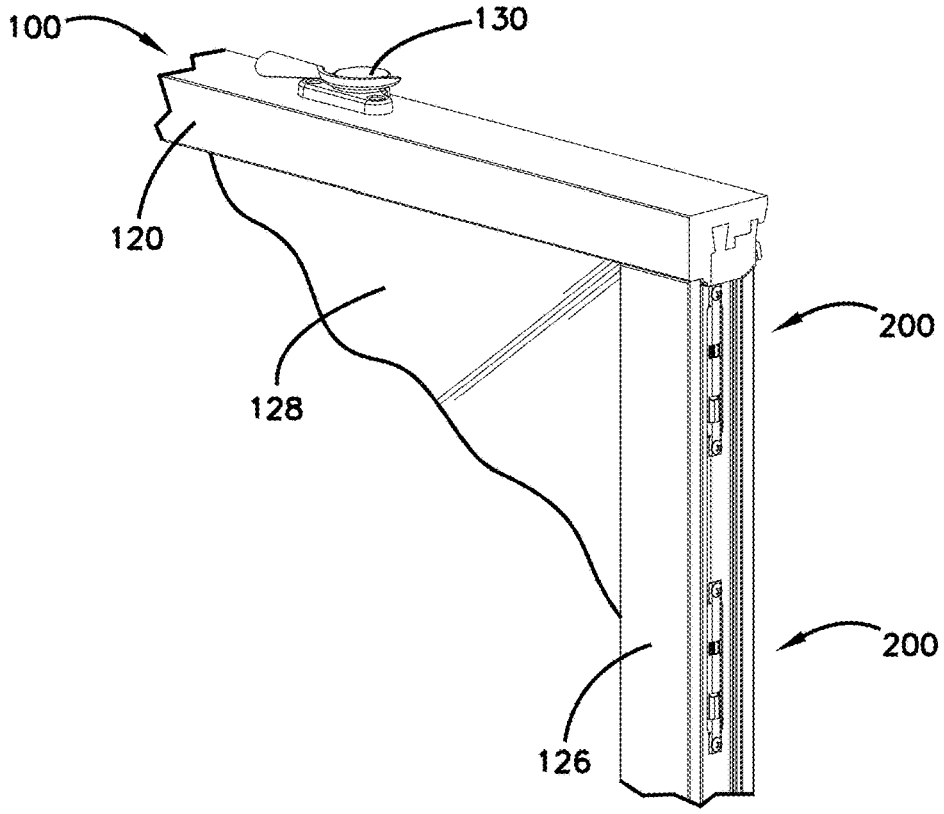
FIG. 5A is an interior perspective view of the sash shown in FIG. 5, with the tilt latch assemblies being shown in the unlatched position.

Referring to FIGS. 3 and 4, the disclosed window assembly 100 and tilt latch design allows the check rail 120 to remain slim while incorporating a concealed tilt latch 200. This is enabled by the unique tilt latch action provided between the sash lock 130 and the tilt latches 200. As configured, the sash lock 130 is configured to perform the dual functions of operating the tilt latches 200 such that the sashes 102, 104 can be pivoted out of the casing 106 and of locking the sashes 102, 104 together such that they are prevented from sliding within the casing 106 and with respect to each other. In one aspect, the primary action of this tilt latch 200 is vertical, allowing the latch 200 to be assembled into the stiles 124, 126 of the sash. The vertical action of this tilt latch 126 also allows multiple latches 200 to be installed in each stile 124, 126. The ability to provide multiple tilt latches can greatly reduce the wind load stress exerted on the stiles 124, 126 and latches 200. For example, FIG. 5 shows a surface mounted lock 130 that operates two tilt latches 200 interconnected by a balance cord, wherein each of the tilt latches 200 is installed within the stile 126.

Figure 6:
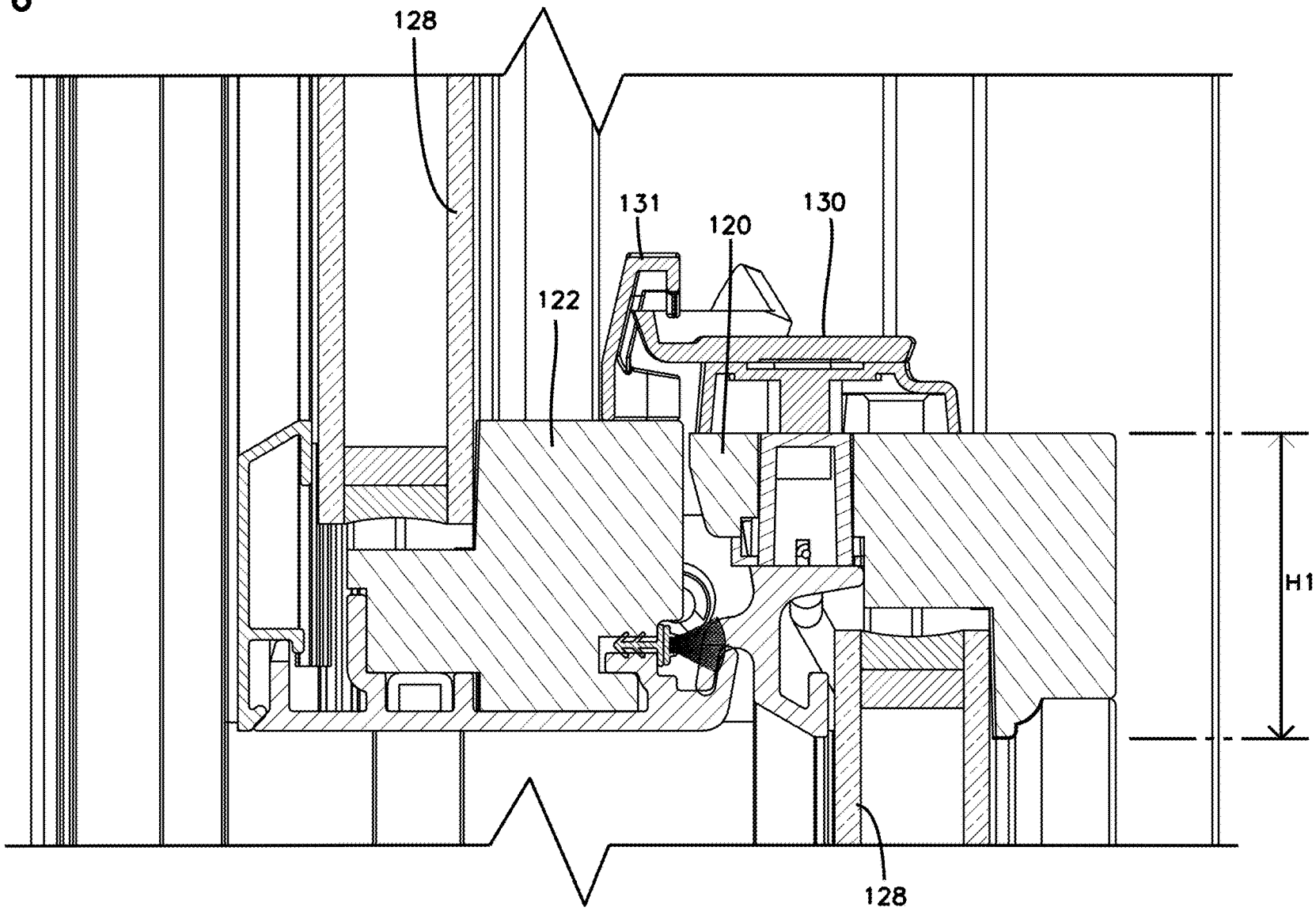
FIG. 6 is a cross-sectional view of the window assembly shown in FIG. 1, taken along the line 6-6 in FIG. 1.

Referring to FIG. 6, the surface mount lock 130 and a tilt latch 200 installed in the stiles 126, 128 is a check rail 120, 122 that has a site line dimension H1 of 1¼". This represents a significant reduction over other existing manufactured window assemblies that have a site line dimension of 1¾" to 2". As related previously, prior art designs having mortised sash locks and check rail mounted tilt latches increase the site line dimension.

Figure 1A:
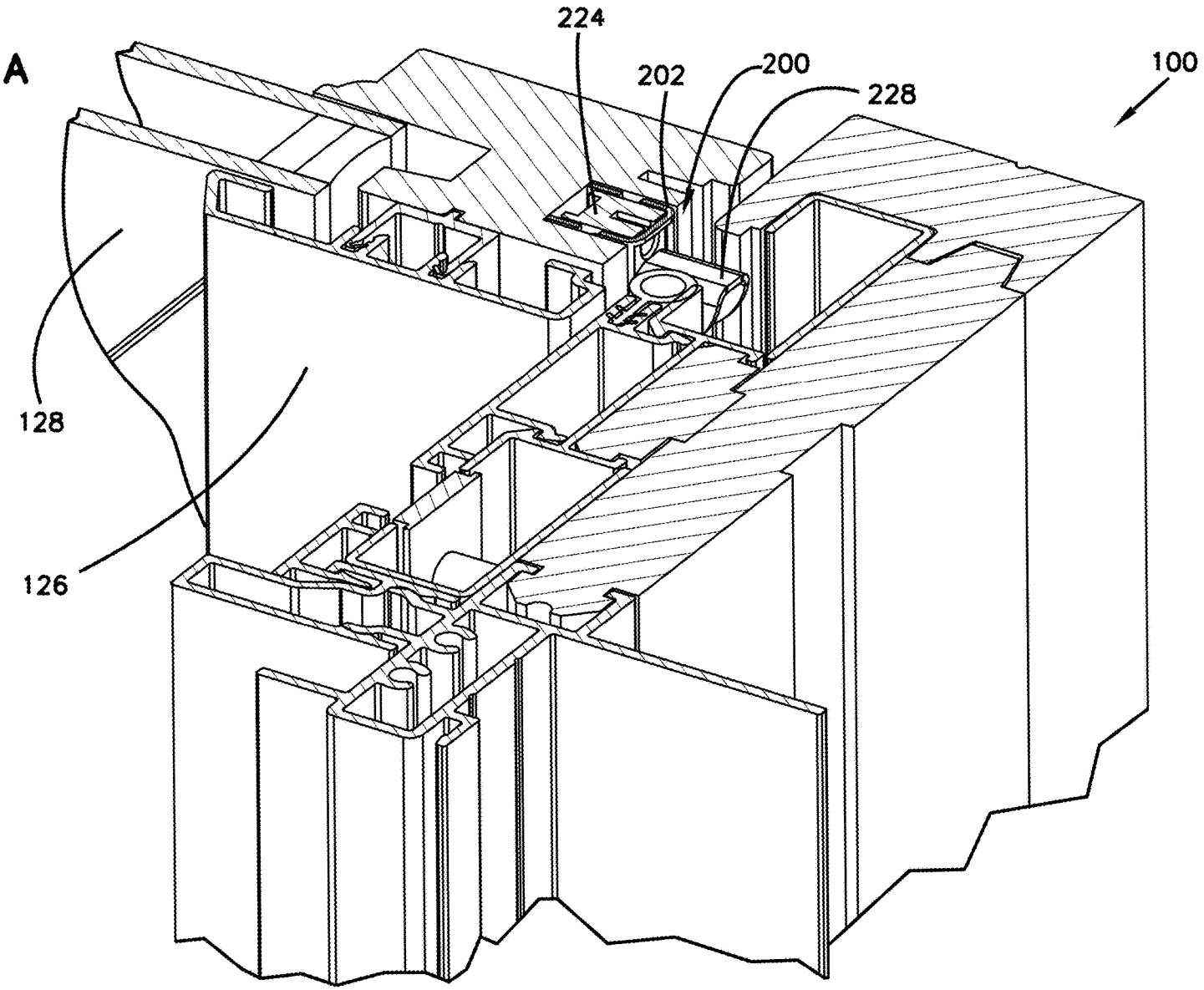
FIG. 1A is a top cross-sectional view of the window assembly shown in FIG. 1.
Figure 2:
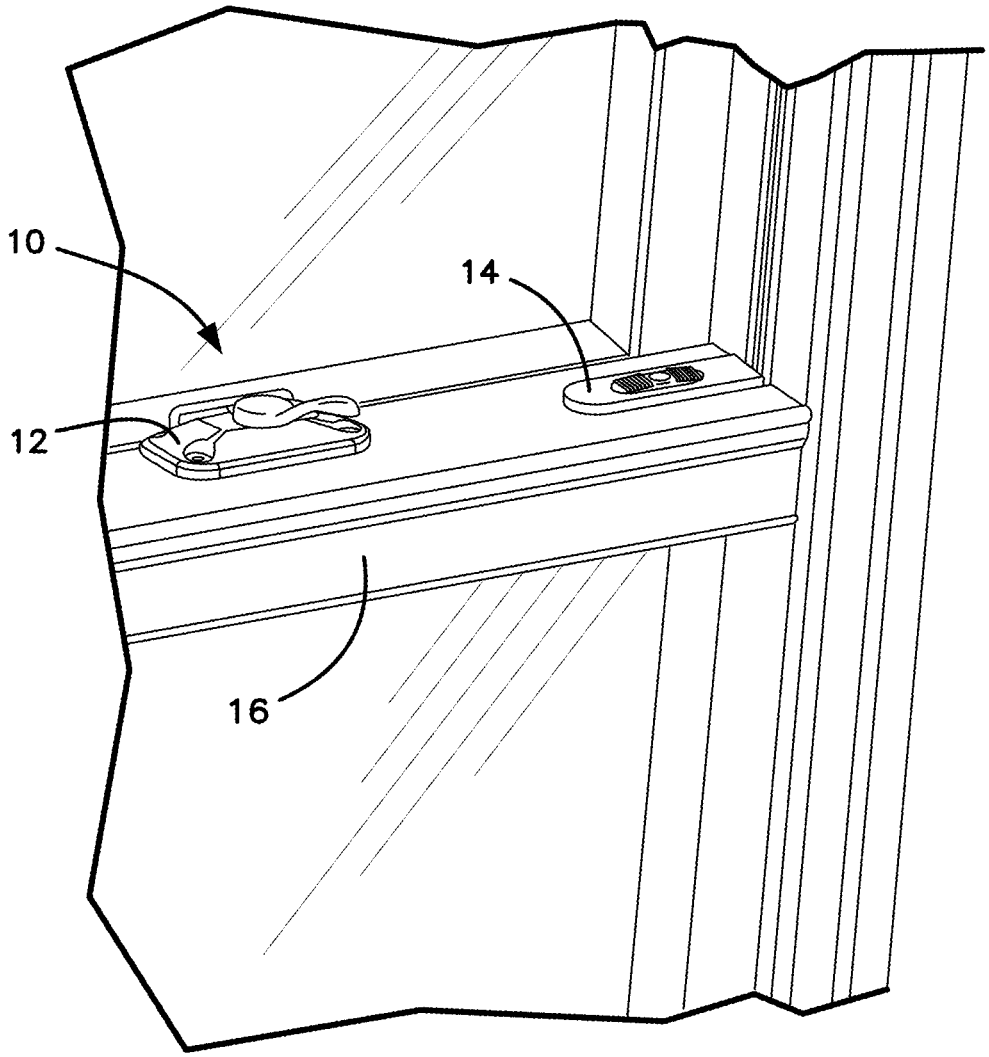
FIG. 2 (PRIOR ART)
FIG. 2 is an interior perspective view of a portion of a prior art window assembly.
Figure 7:
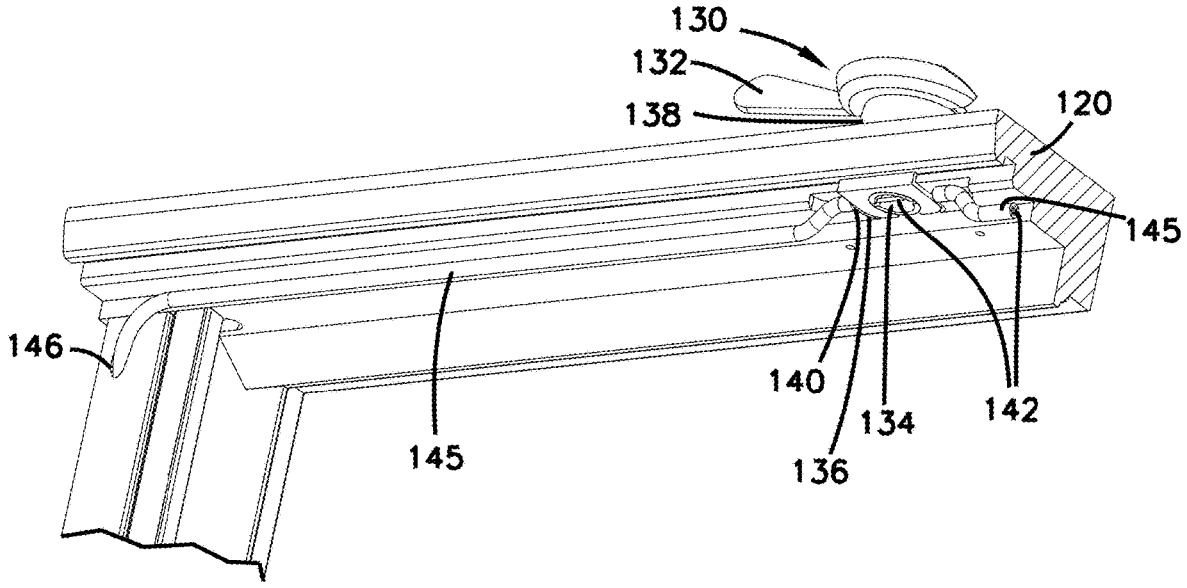
FIG. 7 is an interior perspective view of a portion of the sash shown in FIG. 3.
Figure 8:
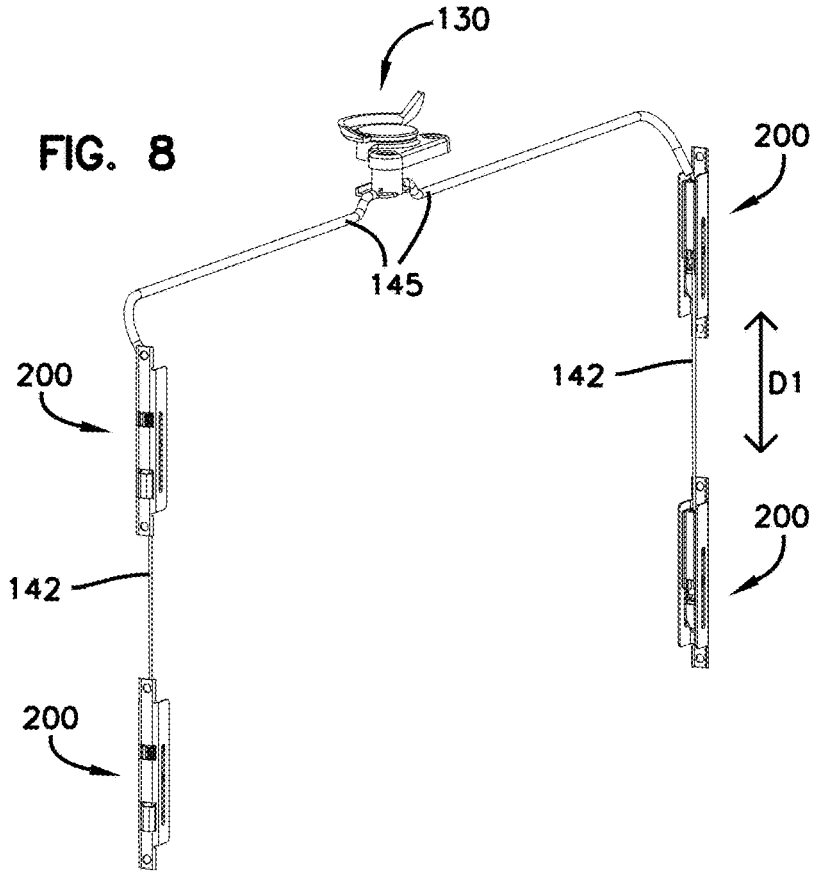
FIG. 8 is a perspective view of the sash lock and tilt latch assembly shown in isolation from the remaining components of the window assembly shown in FIG. 1.
Figure 8A:
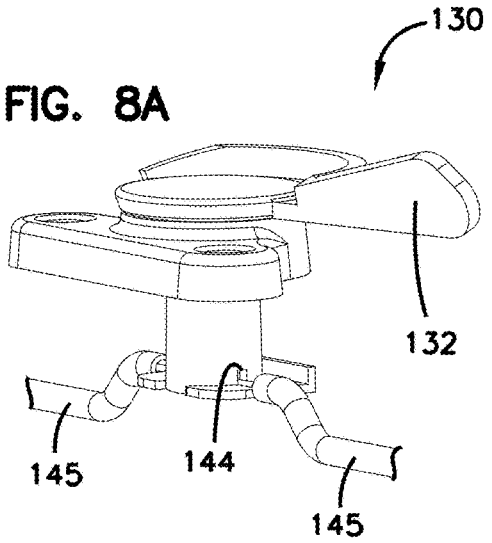
FIG. 8A is a top perspective view of the sash lock shown in FIG. 8.
Figure 8B:
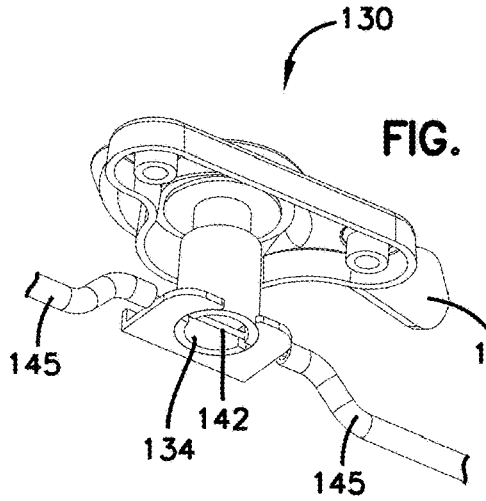
FIG. 8B is a bottom perspective view of the sash lock shown in FIG. 8.
Figure 9:
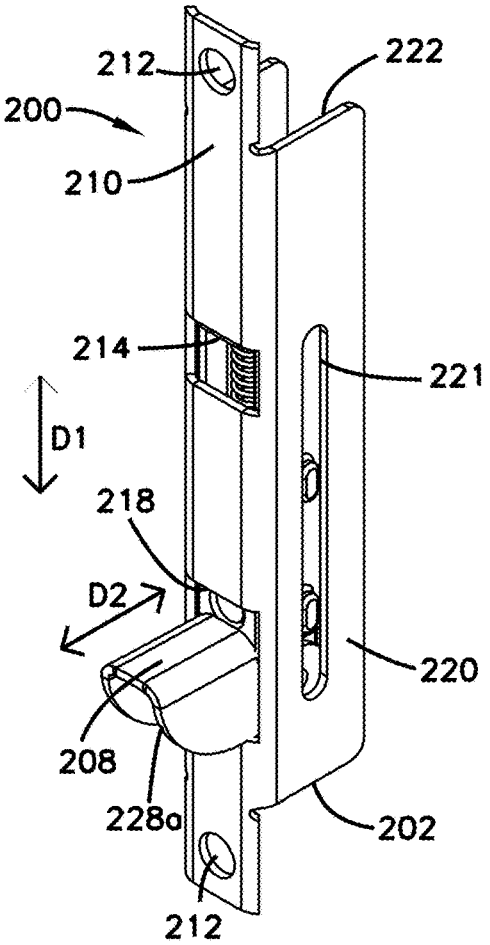
FIG. 9 is a front perspective view of one of the tilt latch assemblies shown in FIG. 8.
Figure 9A:
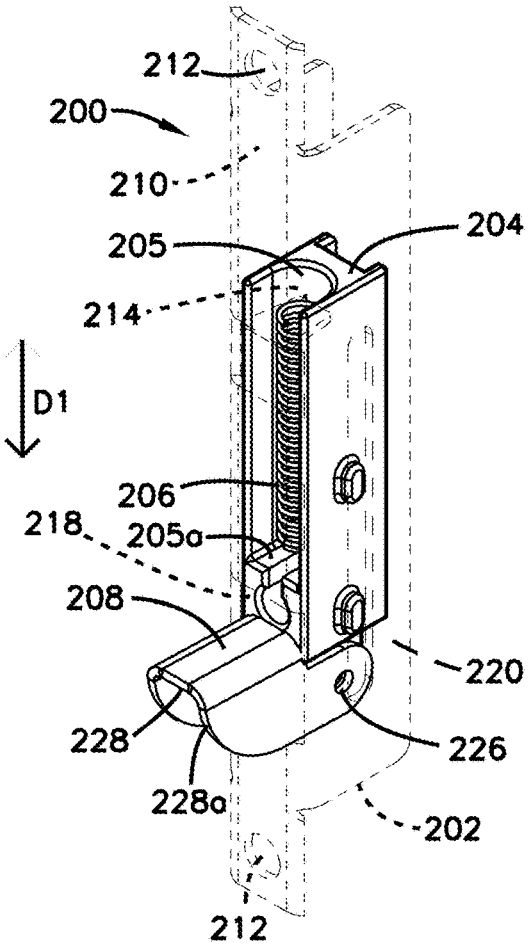
FIG. 9A is a front perspective view of one of the tilt latch assemblies shown in FIG. 9, with portions of the tilt latch assembly being shown as transparent such that interior parts of that tilt latch assembly can be viewed, and with the tilt latch assembly being in a latched position.
Figure 9B:
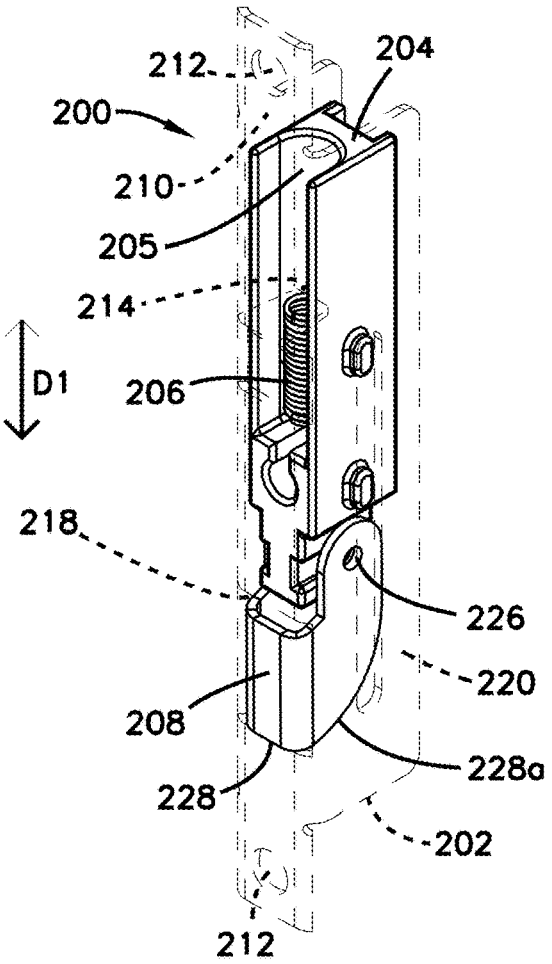
FIG. 9B is a front perspective view of the tilt latch assembly shown in FIG. 9, with portions of the tilt latch assembly being shown as transparent such that interior parts of that tilt latch assembly can be viewed, and with the tilt latch assembly being in an unlatched position.
Figure 9C:
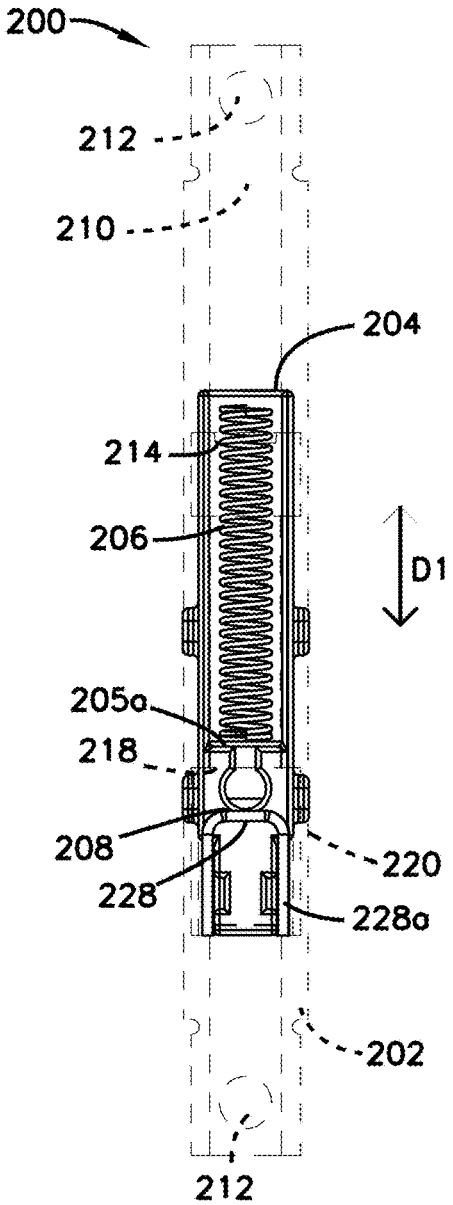
FIG. 9C is a front view of the tilt latch assembly shown in FIG. 9, with portions of the tilt latch assembly being shown as transparent such that interior parts of that tilt latch assembly can be viewed, and with the tilt latch assembly being in a latched position.
Figure 10:
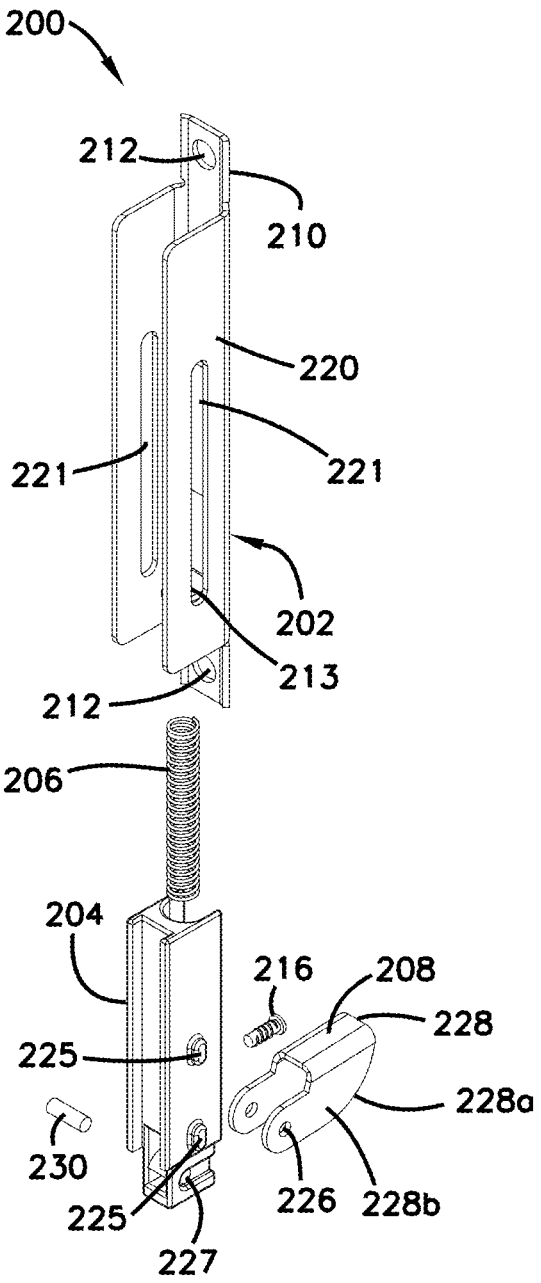
FIG. 10 is an exploded front perspective view of the tilt latch assemblies shown in FIG. 9.
Figure 11:
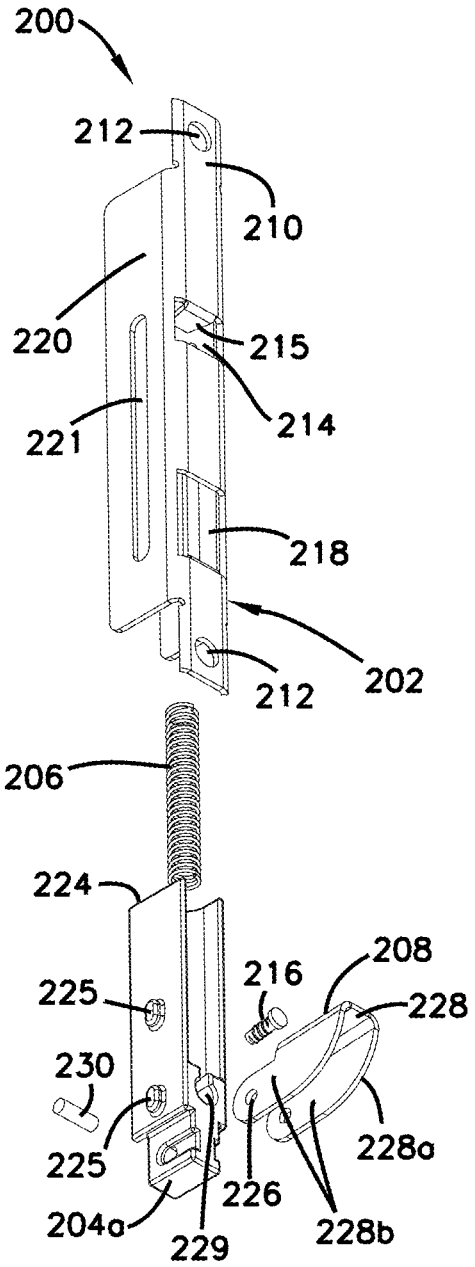
FIG. 11 is an exploded rear perspective view of the tilt latch assembly shown in FIG. 9.

Referring to FIG. 7, a view of the sash 102, 104 is presented in which the sash lock 130 can be seen in greater detail. In one aspect, the sash lock 130 can be provided with a handle 132 and a cord winder 134 extending through a bore hole 136 extending through the check rail 120. As the handle 132 is rotated with respect to a base 138 mounted to the check rail 120, the cord winder 134 is rotated within the bore hole 136. The cord winder 134 is provided with a slot 140 which accepts a nylon balance cord 142 extending though a saw kerf 144 in the check rail 120 and through a channel or kerf 146 in the stiles 124, 126 to the latch assemblies 200 via conduits 145. The balance cord 142 can be routed through a conduit 145 at certain locations, as is shown in the drawings, to protect the balance cord 142 and ensure smooth operation. As the handle 132 is rotated, the cord winder 134 and associated slit 140 are likewise rotated. As the cord winder 134 is rotated by the handle 132, the cord winder 134 pulls the balance cord 142 which in turn exerts a tension force on the latch assemblies 200 such that the latch assemblies 200 can be moved from a latched position to an unlatched position. FIG. 1A shows a cross-sectional view in which one of the disclosed latch assemblies 200 is shown as being in the latched position such that a latch member of the latch assembly 200 is slidably received in a channel of the window casing assembly. As is discussed later, the latch assemblies 200 are provided with biasing springs that ensure tension is maintained on the balance cord 142.

Figure 12D:
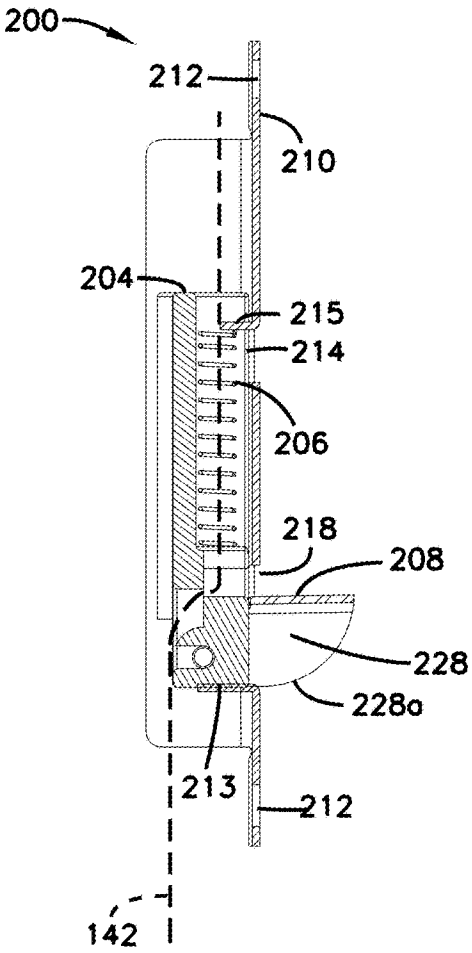
FIG. 12D is a side view of the tilt latch assembly shown in FIG. 12C.
Figure 12C:
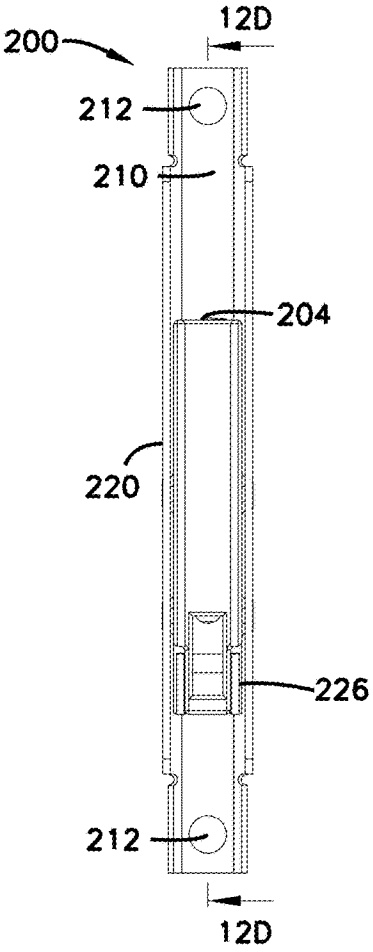
FIG. 12C is a rear view of the tilt latch assembly shown in FIG. 9, with the latch in the latched position.
Figure 12B:
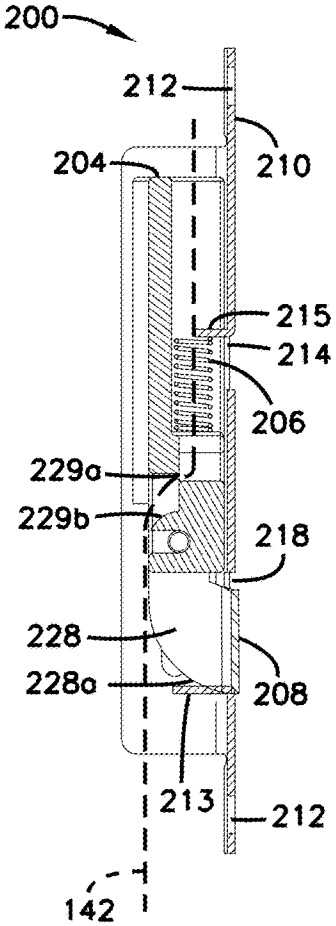
FIG. 12B is a side view of the tilt latch assembly shown in FIG. 12A.
Figure 12A:
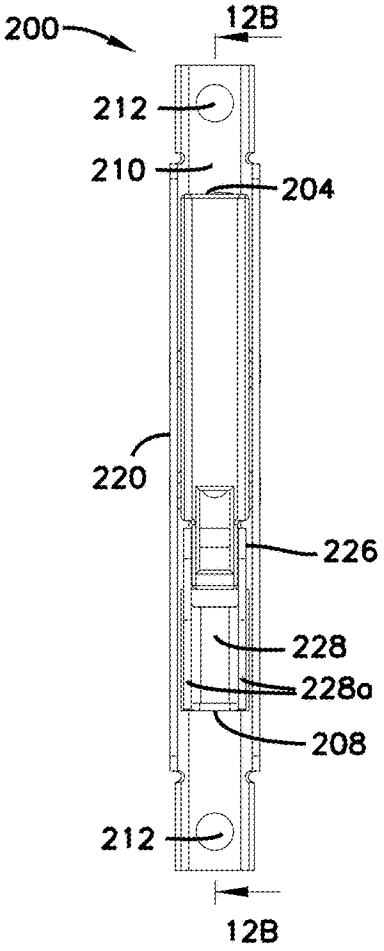
FIG. 12A is a rear view of the tilt latch assembly shown in FIG. 9, with the latch in the unlatched position.

Referring to FIGS. 9 to 12D, a first example of a latch assembly 200 usable with the window assembly 100 is presented. As shown, the latch assembly 200 is provided with a main housing 202, a slide 204, a biasing spring 206, and a latch member 208. In one aspect, the housing 202 is provided with a faceplate 210 defining mounting holes 212 that enable the latch assembly 200 to be secured to the stiles 124, 126 via screws (not shown). The faceplate 210 is also shown as being provided with an aperture 218 through which the latch member 208 can extend. As shown, the faceplate 210 is also provided with an aperture hole 214 through which an adjustment set screw 216 can be accessed. The adjustment set screw 216 is received by a bore 229 in the slide 204 and can be accessed by depressing a tongue 228 of the latch member 208 into the unlatched position (i.e. latch member 208 is depressed into aperture 218). The adjustment set screw 216 extends into the slide 204 to secure the cord 142. Where two latch assemblies 200 are provided in a stile, the cord 142 can extend through the upper latch assembly 204 via an aperture 229*a* in the bore 229 and be secured by a set screw 216 of the lower latch assembly 200 such that the sash lock 130 can operate all of the latch assemblies 200 associated with the window assembly 100. A curved surface 229*b* can be provided in the slide 204 to enable a smoother transition for the cord 142 as well. FIGS. 12B and 12D show this routing pathway for the cord 142, wherein the cord 142 passes into the channel 205, through the spring 206, through the bore 229 and aperture 229*a*, and along the surface 229*b* before extending to the next latch assembly 200. In cases where only one latch assembly 200 is provided, the cord 142 can terminate at the bore 229 and set screw 216. As should be appreciated, any number of latch assemblies 200 can be installed in the stiles 126, 128 and chained together with a balance cord 142. Multiple balance cords instead of a single cord could also be used. In some examples, three or more latch assemblies 200 could be provided in each stile 126, 128.

In one aspect, the main housing 202 is provided with a pair of sidewalls 220 that extend from the faceplate 210 to define an open channel 222. Each of the sidewalls 220 is provided with a slot for receiving protrusions or members 225 on the slide 204 which enables the main housing 202 to secure and guide the slide 204 such that the slide 204 can translate within the channel 222 along a direction D1. The main housing 202 is also provided with a tab or stop structure 215 adjacent the aperture 214. The tab structure 215 provides a stop surface against which one end of the biasing spring 206 can act. The biasing spring 206, which resides in a channel 205 defined within the slide 204, extends from the tab structure 215, to a stop surface 204*a* at the end of the channel 205 the slide 204 and exerts and biasing force against the slide 204. This arrangement enables the latch member 208 to be biased toward the latched position wherein a tongue 228 of the latch member 208 extends through the latch aperture opening 218 in the faceplate 210. This biasing effect creates desirable tension on the balance cord 142. In one aspect, the tab structure 215 extends into the space defined by the channel 205. In one aspect, sidewalls 228*b* of the tongue 228 straddle and engage with a tab structure 213 when the tongue 228 is in the latched position. This engagement allows for loading on the window (e.g. wind loads) to translate force from the tongue 228 onto the main housing 202, both of which can be metal (e.g. stainless steel) components. This configuration advantageously eliminates or minimizes forces being transmitted onto the slide, which can be an injection molded plastic component, from the tongue 228. The tab structure 213 also acts as a stop surface against an end 204*a* of the slide 204, when the latch assembly 200 is in the latched position.

In one aspect, the latch member 208 is provided with a hinge feature 226 to enable the latch member 208 to be rotatably connected to the slide 204. In the particular example shown, the hinge feature 226 includes a through pin 230 which extends through the sidewalls 228*b* of the tongue and through an aperture 227 in the slide 204. Other connection arrangements are possible, such as a rotatable snap-fit connection. In one aspect, the tongue 228 of the latch member 208 is provided with a curved surface 228*a* on the sidewalls 228*b* of the tongue that enables a surface feature of the main housing 202 to guide the tongue 228 into and out of the faceplate aperture 218. In one example, the surface feature is the edge of the faceplate aperture 218.

As the biasing spring 206 exerts a force against the stop surface 205*a* of the slide 204, the tongue 228 is rotated from an unlatched position in which the tongue 228 is retracted from the front surface of the faceplate 210 and is housed within the channel 222 to a latched position in which the tongue 228 extends through the faceplate aperture 218 in a direction D2 that is orthogonal to the direction D1. Thus, the latch assembly can be said to be spring biased into the latched position. By operation of the sash lock 130, the cord 142 is tensioned in a direction opposite the spring force to move the latch member 208 from the latched position into the unlatched position. In one aspect, the sash lock 130 is rotated from a locked position (i.e. engaged with keeper 131) to an unlocked position (i.e. disengaged with keeper 131) through a rotational angle of 126 degrees. Once in this position, the latch assemblies 200 are still in the latched positions in which at least a portion of the tongues 228 extend through apertures 218 to slidably engage with a portion of the window casing assembly. As the sash lock 130 is rotated beyond this position, the latch assemblies 200 can be fully retracted into the unlatched position. In some examples, a detent arrangement (e.g. a spring loaded detent assembly) can be provided such that a user must apply an additional force to rotate the sash lock 130 beyond 126 degrees to place the latch assemblies 200 in the unlatched position. Such an arrangement helps to avoid inadvertent rotation of the sash lock 130 beyond the unlocked position where unlatching of the tilt latch assemblies 200 is not desired.

Referring to FIGS. 13-38, a second example latch assembly 300 is shown. The latch assembly 300 is actuated in the same manner via cords 142, 148 by the sash lock 130 and shares many features in common with latch assembly 200. Accordingly, where like features exist, similar numbering is provided (e.g. 302 instead of 202). However, the shared features of the latch assemblies 200, 300 need not be described again here. Instead, the following description is limited to the differences between the latch assemblies 200, 300. The primary difference between the latch assembly 300 is in the manner in which the latch member is operated.

Figure 13:
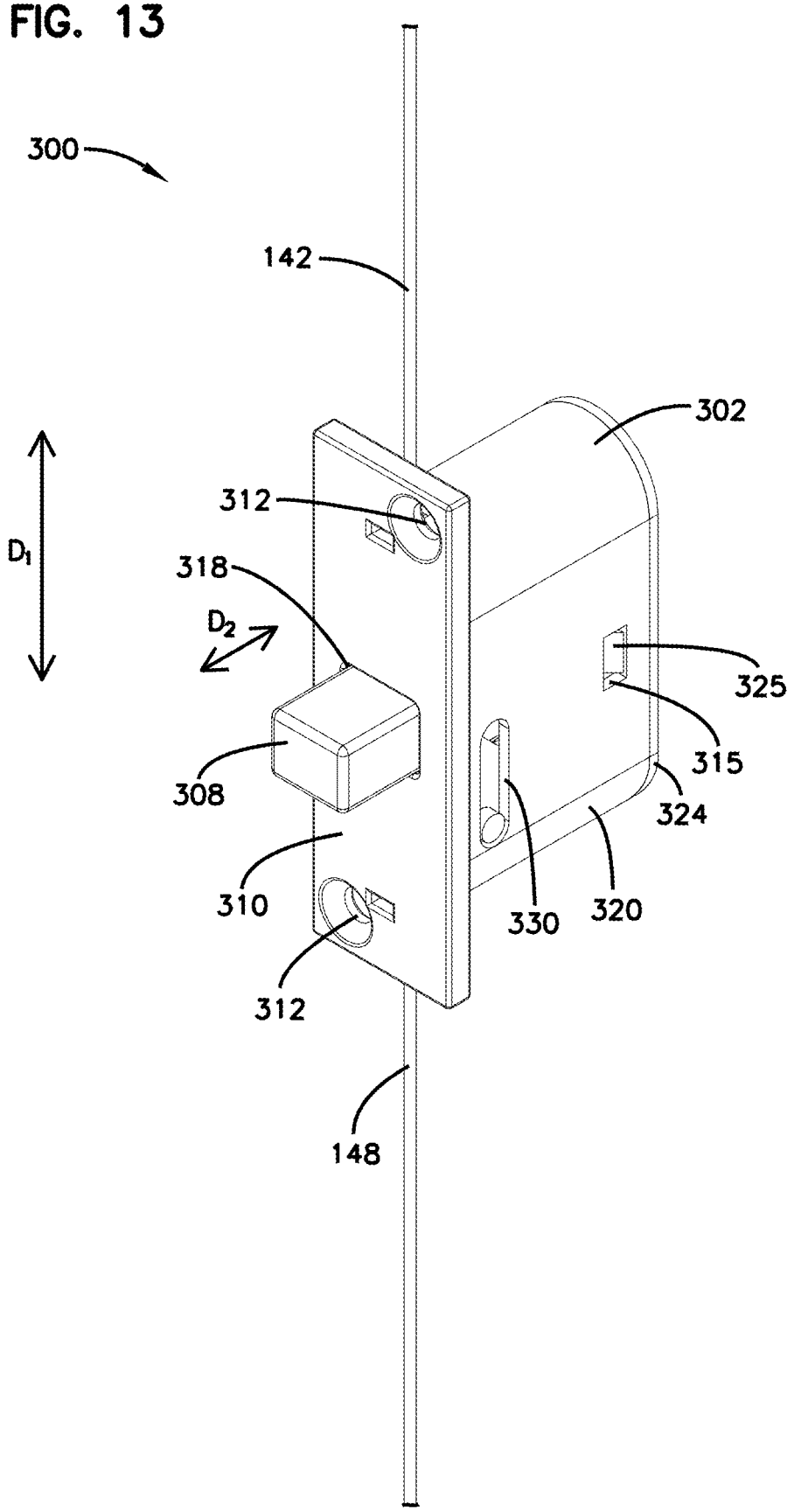
FIG. 13 is a front perspective view of a second example tilt latch assembly usable with the window assembly shown in FIG. 1, with the tilt latch assembly being in a latched position.
Figure 14:
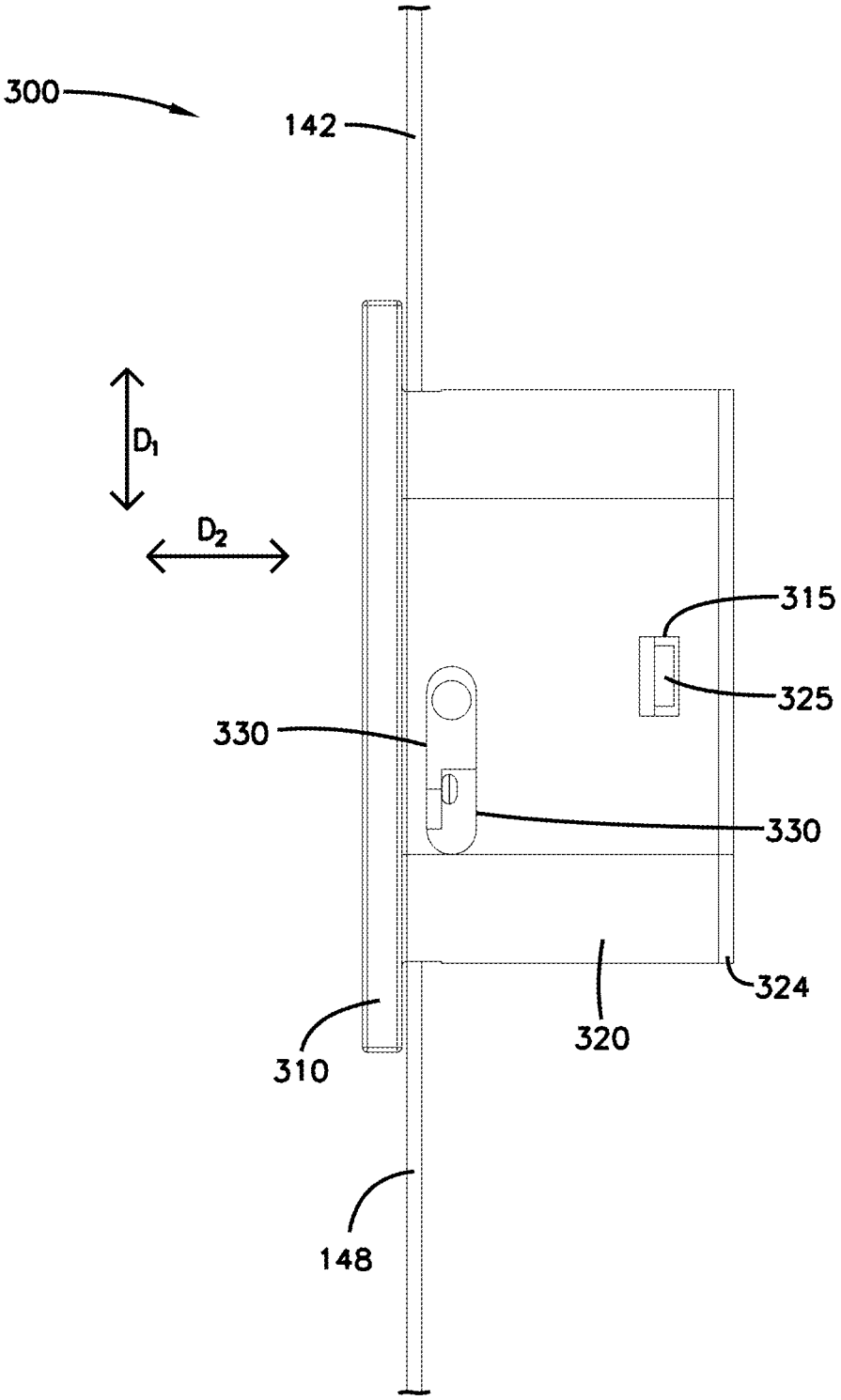
FIG. 14 is a side view of the tilt latch assembly shown in FIG. 13, with the tilt latch assembly being in an unlatched position.
Figure 15:
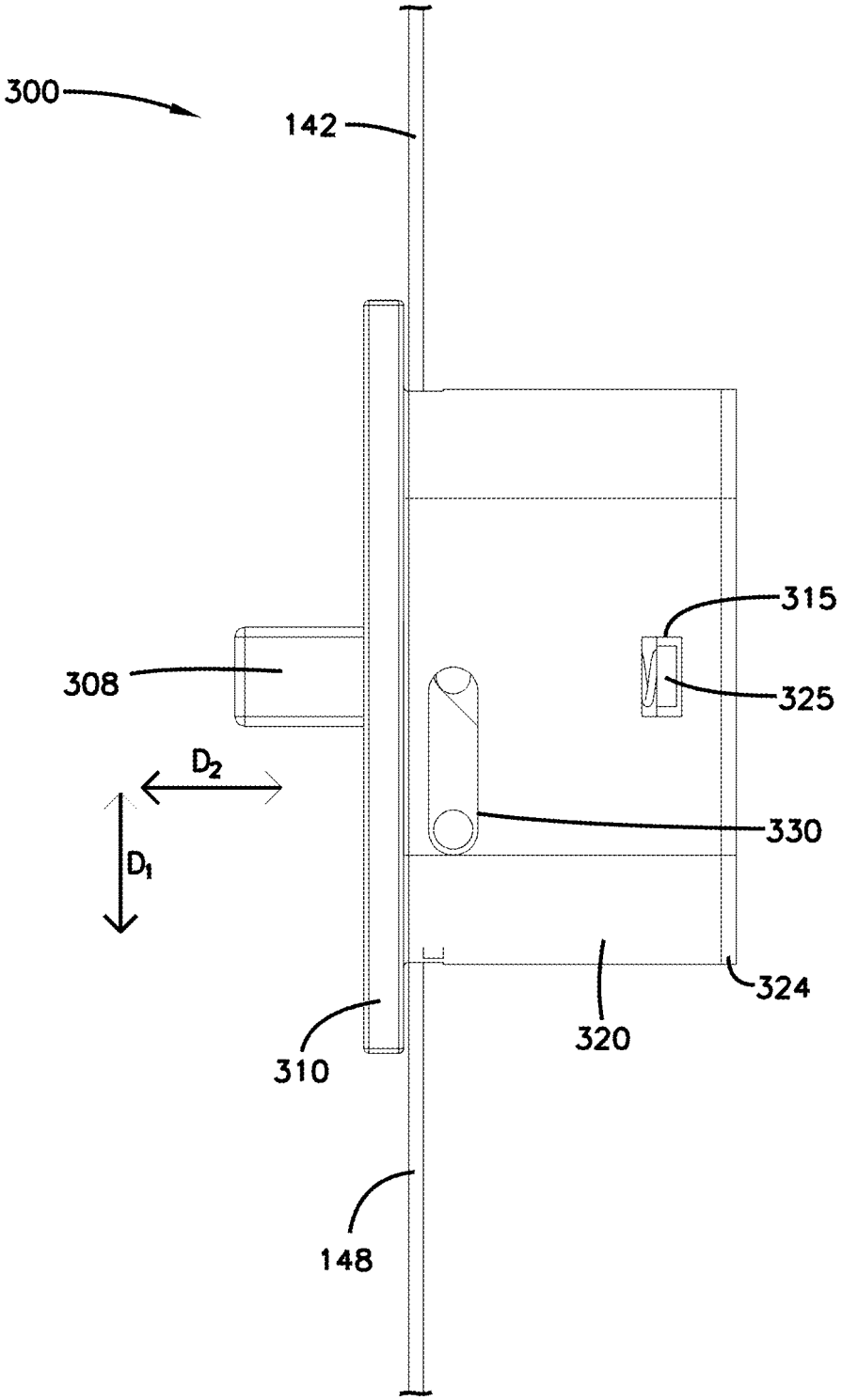
FIG. 15 is a side view of the tilt latch assembly shown in FIG. 13, with the tilt latch assembly being in a latched position.
Figure 16:
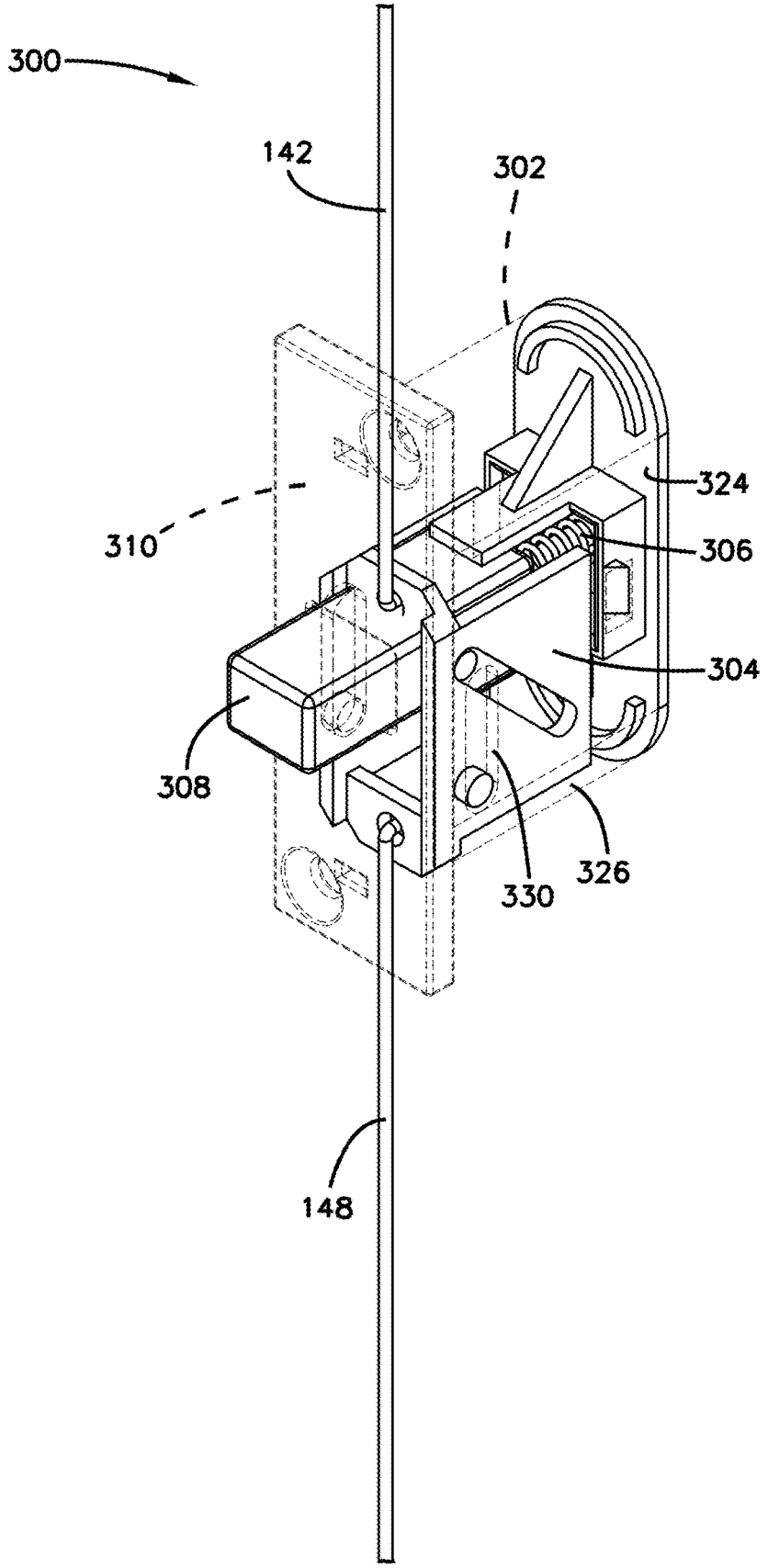
FIG. 16 is a front perspective view of the tilt latch assembly shown in FIG. 13, with portions of the tilt latch assembly being shown as translucent such that interior parts of that tilt latch assembly can be viewed, and with the tilt latch assembly being in a latched position.
Figure 17:
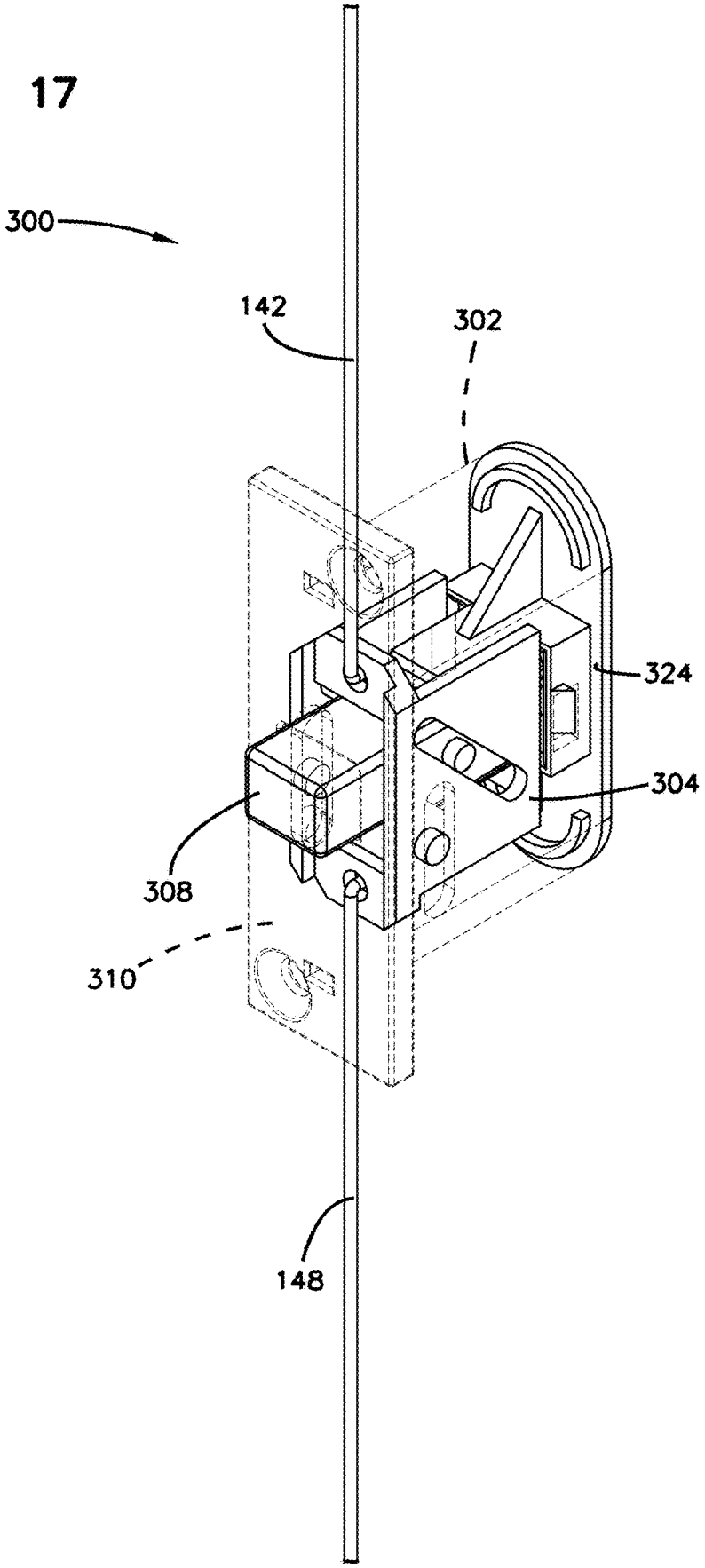
FIG. 17 is a front perspective view of the tilt latch assembly shown in FIG. 16, with the tilt latch assembly being in an intermediate position.
Figure 18:
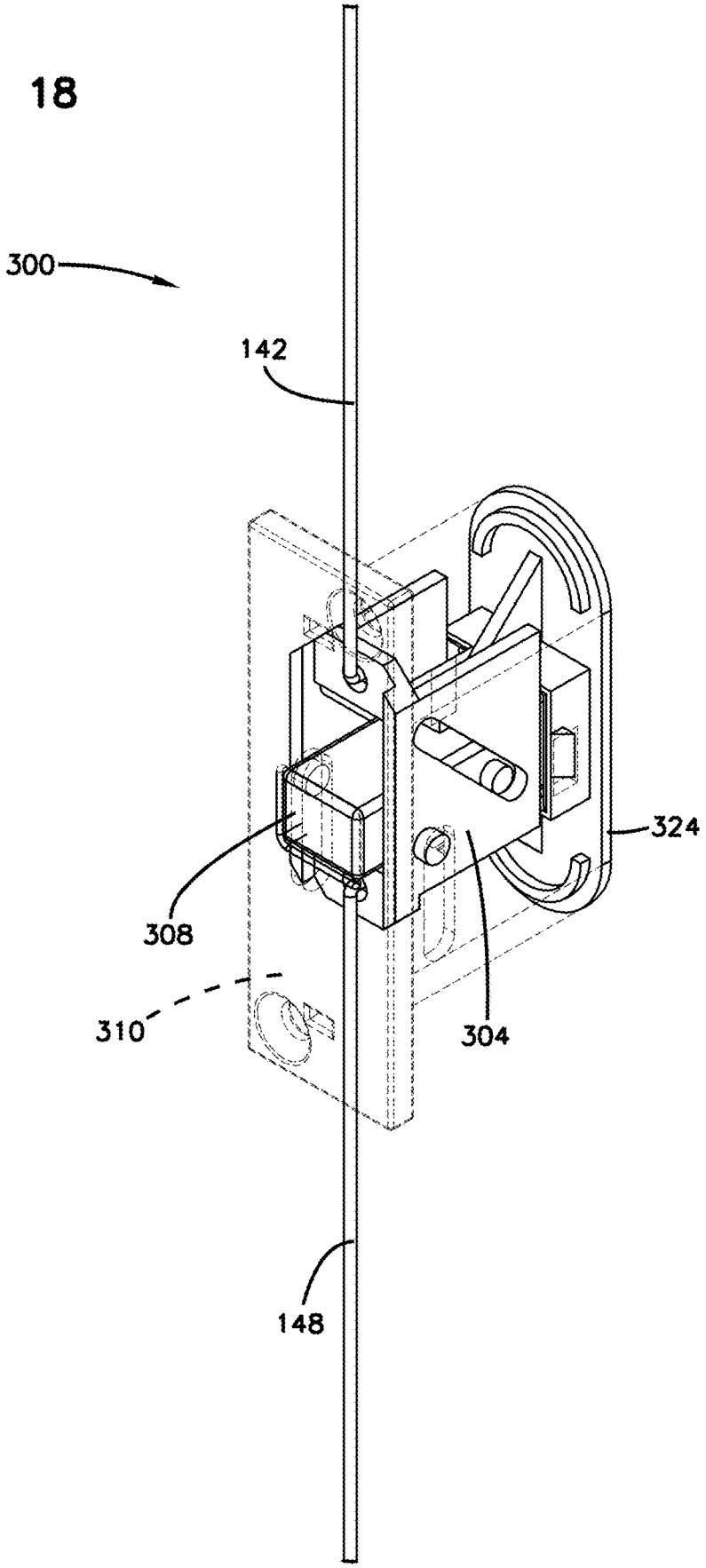
FIG. 18 is a front perspective view of the tilt latch assembly shown in FIG. 16, with the tilt latch assembly being in an unlatched position.
Figure 19:
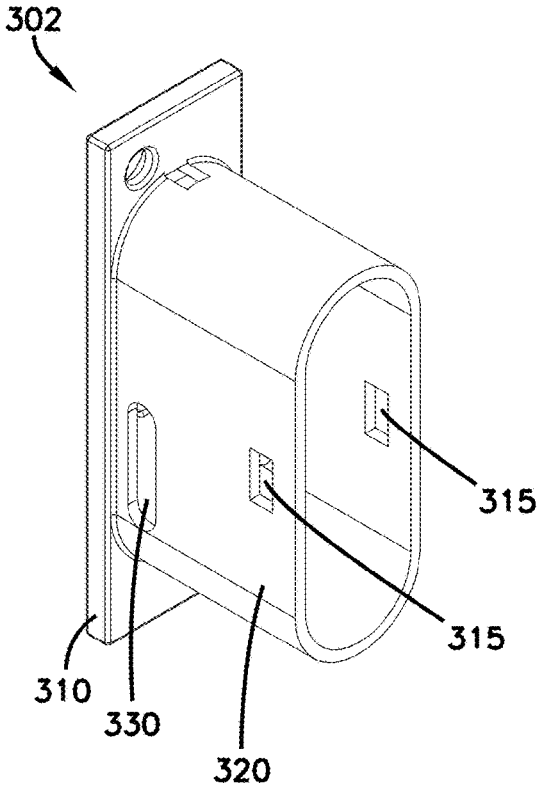
FIG. 19 is a rear perspective view of a main housing of the tilt latch assembly shown in FIG. 13.
Figure 20:
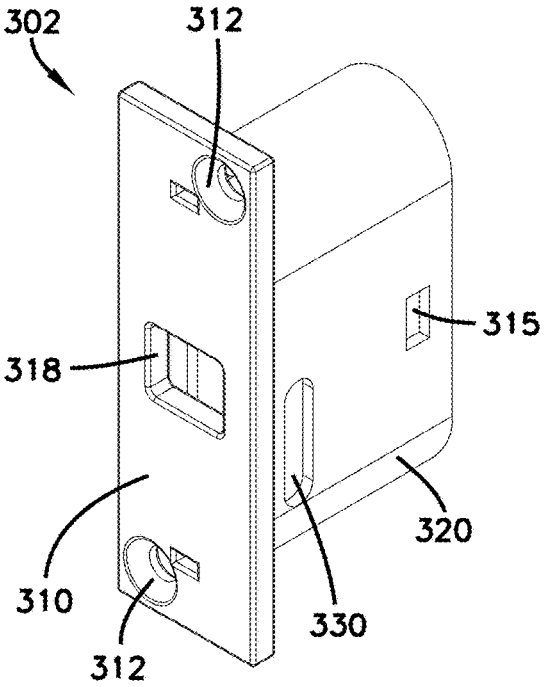
FIG. 20 is a front perspective view of the main housing shown in FIG. 19.
Figure 21:
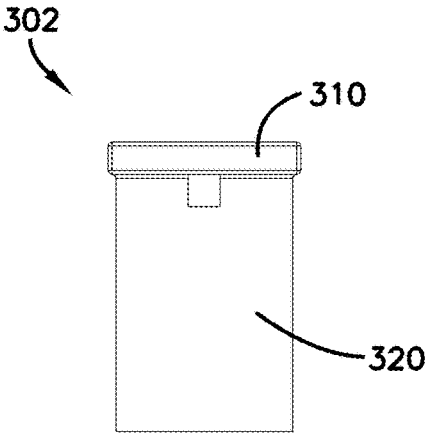
FIG. 21 is a first side view of the main housing shown in FIG. 19.
Figure 22:
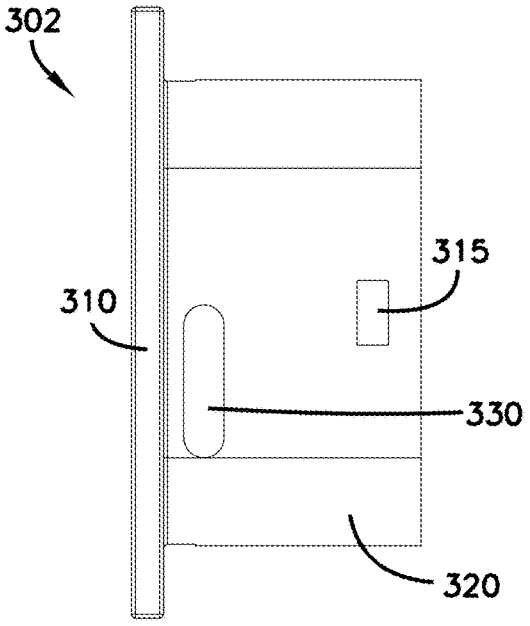
FIG. 22 is a second side view of the main housing shown in FIG. 19.
Figure 23:
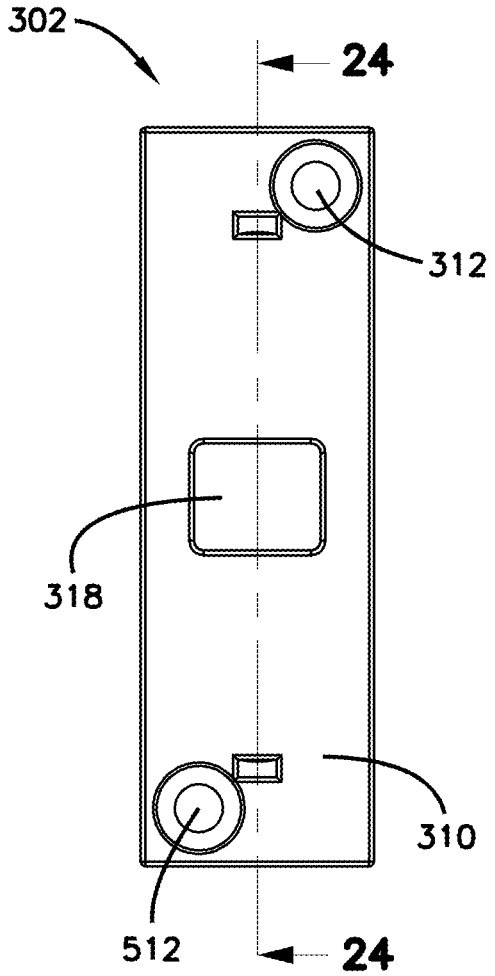
FIG. 23 is a front view of the main housing shown in FIG. 19.
Figure 24:
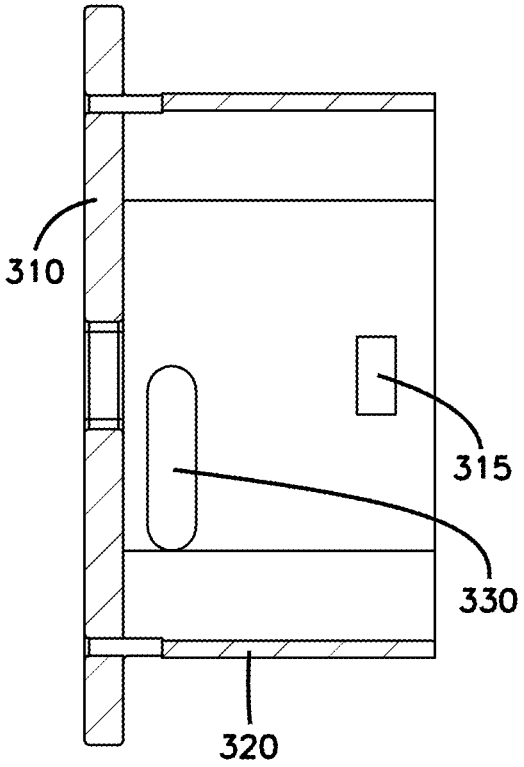
FIG. 24 is a cross-sectional view of the main housing shown in FIG. 19, taken along the line 19-19 shown in FIG. 23.
Figure 25:
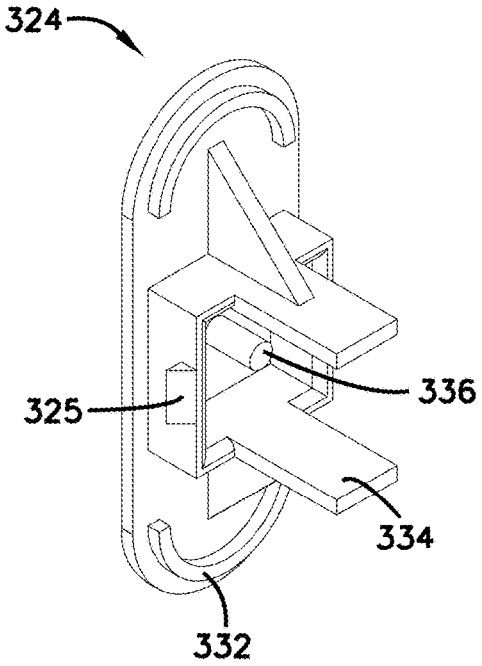
FIG. 25 is a perspective view of a base part of the tilt latch assembly shown in FIG. 13.
Figure 26:
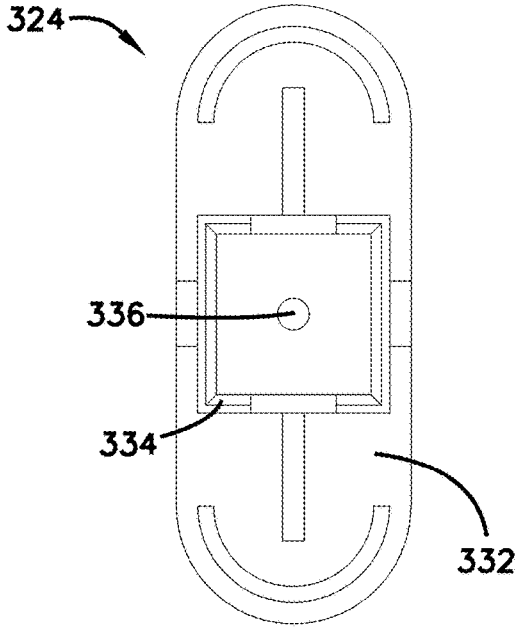
FIG. 26 is a top view of the base part shown in FIG. 25.
Figure 27:
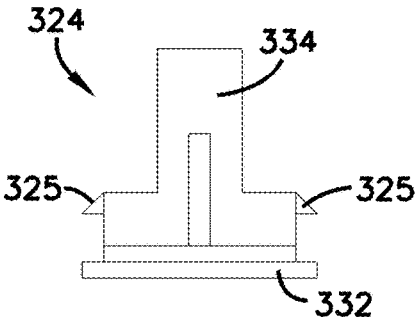
FIG. 27 is a first side view of the base part shown in FIG. 25.
Figure 28:
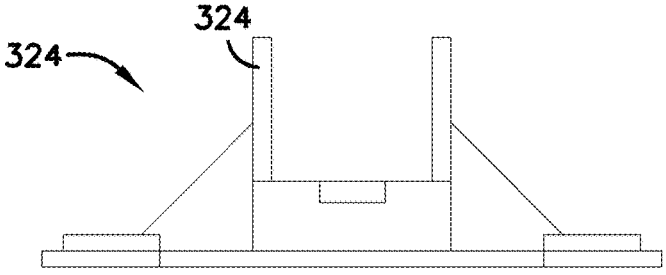
FIG. 28 is a second side view of the base part shown in FIG. 25.
Figure 29:
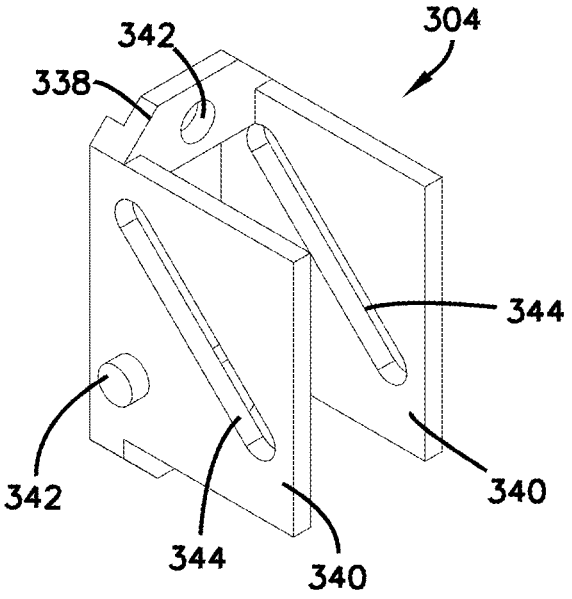
FIG. 29 is a perspective view of a slide part of the tilt latch assembly shown in FIG. 13.
Figure 30:
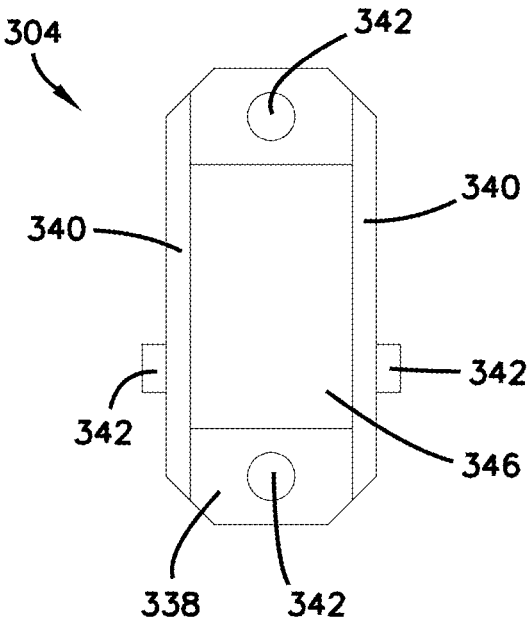
FIG. 30 is a top view of the slide part shown in FIG. 29.
Figure 31:
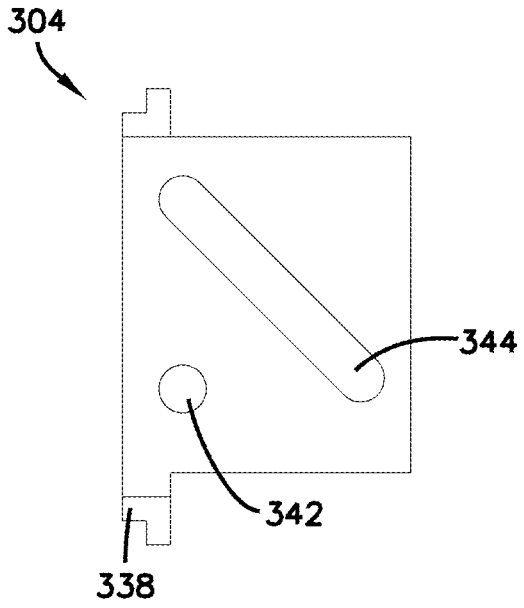
FIG. 31 is a first side view of the slide part shown in FIG. 30.
Figure 32:
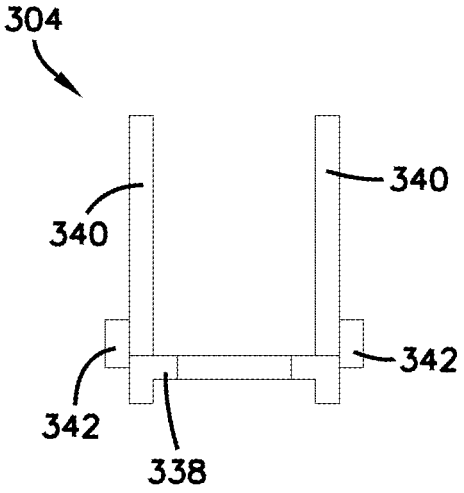
FIG. 32 is a second side view of the slide part shown in FIG. 30.
Figure 33:
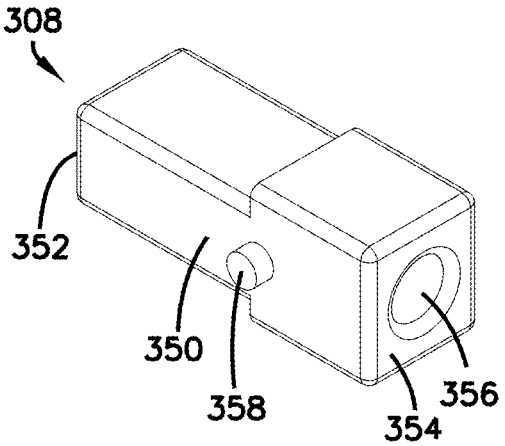
FIG. 33 is a first perspective view of a latch member of the tilt latch assembly shown in FIG. 13.
Figure 34:
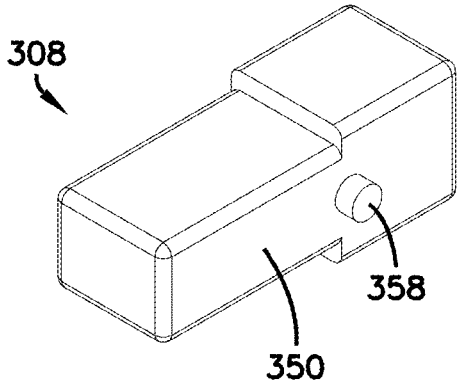
FIG. 34 is a second perspective view of the latch member shown in FIG. 33.
Figure 35:
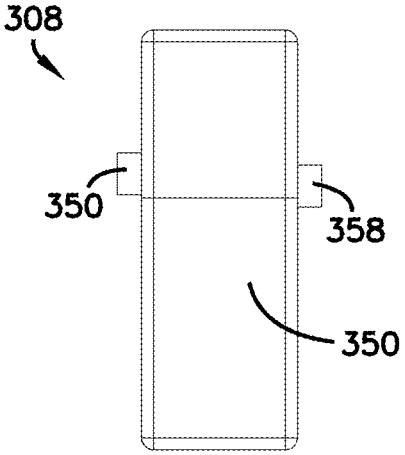
FIG. 35 is a top view of the latch member shown in FIG. 33.
Figure 36:
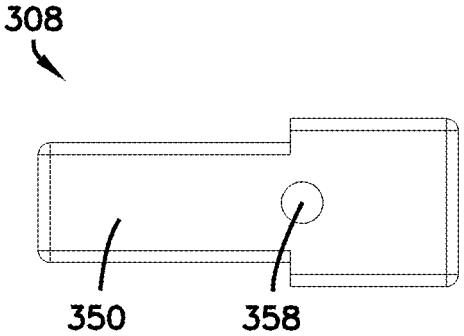
FIG. 36 is a first side view of the latch member shown in FIG. 33.
Figure 37:
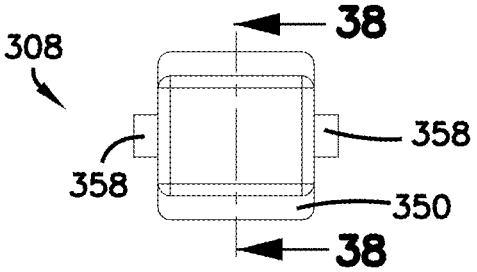
FIG. 37 is a front view of the latch member shown in FIG. 33.
Figure 38:
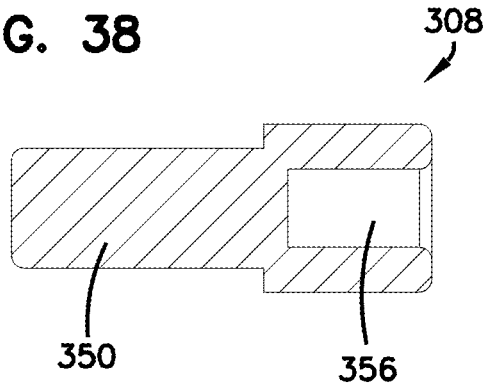
FIG. 38 is a cross-sectional view of the latch member shown in FIG. 33, taken along the line 38-38 shown in FIG. 37.

As shown, the latch assembly 300 includes a main housing 302 having a faceplate 310 with mounting holes 312 from which a sidewall 320 extends. The main housing 302 is shown in isolation at FIGS. 19-24. In one aspect, the sidewall 320 includes a slot 330 extending along the direction D1. The sidewall 320 is also shown as including a pair of apertures 315 for receiving corresponding latch members 325 of an end cap 324. The faceplate 310 additionally includes an aperture 318 through which a latch member 308 can extend. The latch assembly 300 is shown as additionally including a slide 304 and a biasing spring 306 that acts against the end cap 324 and latch member 308 such that the latch assembly 300 is spring biased into the latched position. FIGS. 14 and 18 show the latch assembly 300 in the unlatched position in which the latch member 302 is retracted from the outer face of the faceplate 310 and is housed within the main housing 302. FIGS. 13 and 15-16 show the latch assembly 300 in the latched position in which the latch member 302 extend through the faceplate aperture 318 such that the latch member 302 can engage with the sash stile 124, 126. FIG. 17 shows the latch assembly 300 in an intermediate position between the latched and unlatched positions.

The end cap 324 is shown in isolation at FIGS. 25-28. As shown, the end cap 324 includes a base 332, a guide structure 334, and a guide pin 336. The base 332 closes the interior space defined by the housing sidewall 320. The walls of the guide structure 334 guide the latch member 308 such that the movement of the latch member 334 is limited to sliding along direction D2. The guide pin 336 provides a mounting location for the biasing spring 306. As mentioned previously, the end cap 324 includes latch members 325 for providing a snap-fit type connection between the main housing 302 and the end cap 324.

Figure 39:
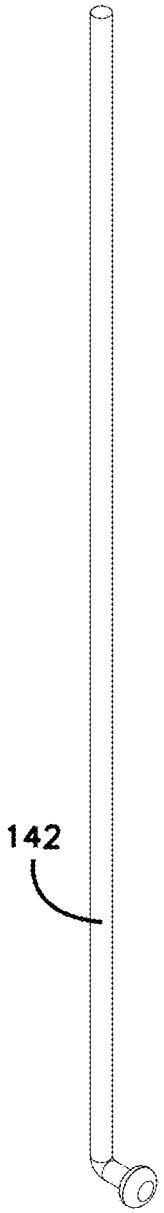
FIG. 39 is a perspective view of a balance cord usable with the tilt latch assembly shown in FIG. 13.
Figure 40:
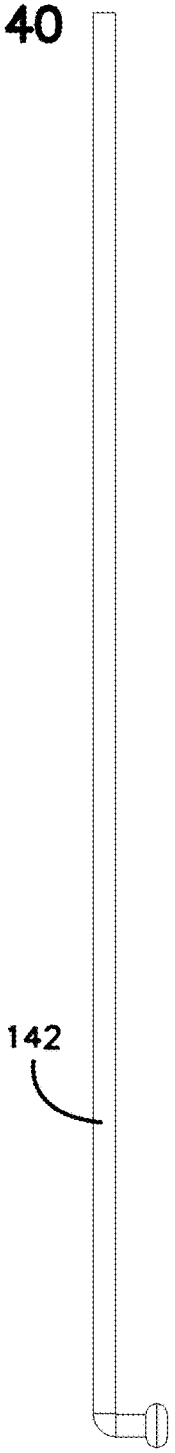
FIG. 40 is a side view of the balance cord shown in FIG. 39.
Figure 41:
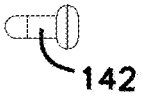
FIG. 41 is a top view of the balance cord shown in FIG. 39.

The slide 304 is shown in isolation at FIGS. 29-32. As shown, the slide 304 includes an end wall 338 from which a pair of sidewalls 340 extend. The end wall 338 includes apertures 342 that are used to engage with the hook members of the cords 142, 148 shown in FIGS. 39-41. The end wall 338 additionally includes a central aperture 346 through which the latch member 308 can extend. The sidewalls 340 each include a pin member 342 which engages with the slot 330 of the housing 302 such that the slide member can slide relative to the housing 302 along the direction D1. The sidewalls 340 also each define a diagonal slot 344 that is disposed at an oblique angle with respect to both of directions D1 and D2. In one example, the slot 344 is disposed at an angle of about 45 degrees with respect to directions D1 and D2.

The latch member 308 is shown in isolation at FIGS. 33-38. As shown, the latch member 308 includes a main body 350 having a latch end 352 and a spring end 354. At the spring end 354, the main body 350 is provided with a bore 356 for accepting the biasing spring 306. Accordingly, the spring 306 directly acts on the latch member 308 to bias the latch member 308 into the latched position. The main body 250 is also provided with a pair of pins 358 that slidably engage with the diagonal slot 344 in the slide 304. Accordingly, when tension is applied to cord 142, the slide 304 is pulled along direction D1 and the diagonal slots 344 forces the latch member 308 to retract in direction D2 into the unlatched position by virtue of the interaction between the diagonal slots 344 and the pins 358.

Based on the foregoing, numerous variations are possible for forming various window frame assemblies. Although a number of examples are presented herein, many more are possible without departing from the concepts presented herein.

With regard to the foregoing description, it is to be understood that changes may be made in detail, especially in matters of the construction materials employed and the shape, size and arrangement of the parts without departing from the scope of the present disclosure. It is intended that the specification and depicted aspects be considered exemplary only, with a true scope and spirit of the invention being indicated by the broad meaning of the following claims.

I claim:

1. A window assembly comprising:

a. a window casing assembly;

b. a first sash assembly slidably mounted within the window casing assembly, the first sash assembly including first and second stiles extending between first and second rails;

c. a first tilt latch assembly mounted in the first stile, the first tilt latch assembly including a first latch member slidably received within a first slide member, the first slide member being slidably received within a first main housing received in the first stile, wherein the first slide member slides in a first direction parallel to a length of the first stile;

d. a second tilt latch assembly mounted in the second stile; and e. a sash lock mounted to the first rail, the sash lock being operably connected to the first and second tilt latch assemblies to operate the first and second tilt latch assemblies between a latched position in which a latch member of each of the first and second tilt latch assemblies operably engages with the window casing and an unlatched position in which the latch member of each of the first and second tilt latch assemblies is operably disengaged with the window casing assembly.

2. The window assembly of claim 1, wherein two first tilt latch assemblies are provided in the first stile and two second tilt latch assemblies are provided in the second stile.

3. The window assembly of claim 1, wherein the window assembly is a double hung window including a second sash assembly.

4. The window assembly of claim 3, wherein the sash lock secures the first sash assembly to the second sash assembly when the sash lock is in a locked position.

5. The window assembly of claim 1, wherein the first and second tilt latch assemblies are connected to the sash lock by a balance cord.

6. The window assembly of claim 1, wherein each of the first and second tilt latch assemblies are spring biased into the latched position.

7. The window assembly of claim 1, wherein the latch member of each of the first and second tilt latch assemblies is in direct contact with the respective main housing of the first and second tilt latch assembly when in the latched position.

8. The latch assembly of claim 1, wherein the second latch assembly includes a second latch member slidably received within a second slide member, the second slide member being slidably received within a second main housing received in the second stile, wherein the second slide member slides in a second direction parallel to a length of the second stile.

9. The latch assembly of claim 1, wherein the first latch member includes a pair of first protrusions received in a pair of first slots defined in the first slide member.

10. The latch assembly of claim 9, wherein the first slide member includes a pair of second protrusions slidably received in a pair of second slots defined in the first main housing.

11. A window assembly comprising:

a. a window casing assembly;

b. a first sash assembly slidably mounted within the window casing assembly;

c. a tilt latch assembly mounted to a stile of the first sash assembly, the tilt latch assembly including a latch member; and d. a sash lock mounted to a rail of the sash assembly, the sash lock operating the tilt latch assembly between a latched position in which the latch member operably engages with the window casing and an unlatched position in which the latch member is disengaged from the window casing assembly; and e. wherein the tilt latch assembly includes a main housing and a slide member slidably retained within the main housing, wherein the latch member is rotatably connected to the slide member, and wherein movement of the slide member in a direction parallel to a length of the stile of the first sash assembly operates the latch assembly between the latched and unlatched positions.

12. The window assembly of claim 11, wherein the sash lock secures the first sash assembly to the second sash assembly when the sash lock is in a locked position.

13. The window assembly of claim 11, wherein the tilt latch assembly is connected to the sash lock by a balance cord.

14. The window assembly of claim 11, wherein the tilt latch assembly is spring biased into the latched position.

* * * * *